US010784590B2

(12) United States Patent
Maccabe et al.

(10) Patent No.: US 10,784,590 B2
(45) Date of Patent: Sep. 22, 2020

(54) ULTRA-WIDE BANDWIDTH FREQUENCY-INDEPENDENT CIRCULARLY POLARIZED ARRAY ANTENNA

(71) Applicant: BAE SYSTEMS INFORMATION AND ELECTRONIC SYSTEMS INTEGRATION INC., Nashua, NH (US)

(72) Inventors: Andrew C. Maccabe, Milford, NH (US); James F. Fung, Manchester, NH (US); Randall R. Lapierre, Hooksett, NH (US); Benjamin G. McMahon, Nottingham, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 196 days.

(21) Appl. No.: 16/029,222

(22) Filed: Jul. 6, 2018

(65) Prior Publication Data

US 2020/0014121 A1 Jan. 9, 2020

(51) Int. Cl.

| | |
|---|---|
| ***H01Q 1/36*** | (2006.01) |
| ***H01Q 21/24*** | (2006.01) |
| ***H01Q 11/10*** | (2006.01) |
| ***H01Q 15/24*** | (2006.01) |
| ***H01Q 19/10*** | (2006.01) |
| ***H01Q 1/50*** | (2006.01) |

(52) U.S. Cl.

CPC ..... *H01Q 21/24* (2013.01); *H01Q 1/36* (2013.01); *H01Q 1/50* (2013.01); *H01Q 11/10* (2013.01); *H01Q 15/24* (2013.01); *H01Q 19/10* (2013.01)

(58) Field of Classification Search

CPC ..... H01Q 21/24; H01Q 19/10; H01Q 15/24; H01Q 11/10; H01Q 1/36; H01Q 1/50

See application file for complete search history.

(56) References Cited

U.S. PATENT DOCUMENTS

| | | | |
|---|---|---|---|
| 2004/0027308 | A1 | 2/2004 | Lynch et al. |
| 2005/0030246 | A1 | 2/2005 | Durham et al. |
| 2005/0134404 | A1 | 6/2005 | Kajiya |
| 2005/0237267 | A1 | 10/2005 | Brown et al. |
| 2009/0267859 | A1 | 10/2009 | Koh et al. |

(Continued)

OTHER PUBLICATIONS

International Search Report, PCT/US19/38890, dated Sep. 20, 2019, 14 pages.

(Continued)

*Primary Examiner* — Dieu Hien T Duong

(74) *Attorney, Agent, or Firm* — Sand, Sebolt & Wernow LPA; Scott J. Asmus

(57) ABSTRACT

An array antenna has a plurality of antenna unit cells arranged in rows and columns, or in another configuration. Each unit cell from the plurality of unit cells includes a circularly polarized radiator and a balun. The array antenna further includes a reactive element or a circuit element (such as a capacitor or resistor or even an inductor) on the circularly polarized radiator that is coupled an adjacent unit cell in one of the row and the column. A spacing distance between adjacent unit cells coupled via the circuit element that is at most half of a wavelength at a frequency maximum of the array antenna, wherein the spacing distance reduces likelihood of grating lobes.

19 Claims, 14 Drawing Sheets

(56) References Cited

U.S. PATENT DOCUMENTS

| | | | | |
|---|---|---|---|---|
| 2009/0303002 | A1 | 12/2009 | Rossman | |
| 2010/0271280 | A1* | 10/2010 | Pickles | H01Q 9/16 343/858 |
| 2012/0001715 | A1 | 1/2012 | Taracila et al. | |
| 2014/0225698 | A1 | 8/2014 | Swirhun et al. | |
| 2015/0070215 | A1 | 3/2015 | Alexopoulos et al. | |
| 2015/0200460 | A1 | 7/2015 | Isom et al. | |
| 2017/0084978 | A1 | 3/2017 | White | |

OTHER PUBLICATIONS

Sáenz et al., "A Dual-Polarized Wideband Planar Phased Array With Spiral Antennas," IEEE Transactions on Antennas and Propagation, Sep. 2014, pp. 4547-4553, vol. 62, No. 9.

* cited by examiner

ULTRA-WIDE BANDWIDTH FREQUENCY-INDEPENDENT CIRCULARLY POLARIZED ARRAY ANTENNA

BACKGROUND

Technical Field

The present disclosure relates generally to antennas. More particularly, the present disclosure relates to a circularly polarized array antenna. Specifically, the present disclosure relates to a circularly polarized array antenna having unit cells that are coupled to adjacent unit cells via react elements or circuit elements that have a spacing distance of at most have of the wavelength at a frequency maximum which reduces the likelihood, or even eliminates, grating lobes.

Background Information

An antenna is a transducer that converts radio frequency electric current to electromagnetic waves that are then radiated into space. The electric field or "E" plane determines the polarization or orientation of the radio wave. In general, most antennas radiate either linear or circular polarization.

A linear polarized antenna radiates wholly in one plane containing the direction of propagation. In a circular polarized antenna, the plane of polarization rotates in a circle making one complete revolution during one period of the wave. If the rotation is clockwise looking in the direction of propagation, the sense is called right-hand-circular (RHC). If the rotation is counterclockwise, the sense is called left-hand-circular (LHC).

An antenna is said to be vertically polarized (linear) when its electric field is perpendicular to the Earth's surface. An example of a vertical antenna is a broadcast tower for AM radio or the "whip" antenna on an automobile. Horizontally polarized (linear) antennas have their electric field parallel to the Earth's surface. Television transmissions in the USA use horizontal polarization.

A circular polarized wave radiates energy in both the horizontal and vertical planes and all planes in between. The difference, if any, between the maximum and the minimum peaks as the antenna is rotated through all angles, is called the axial ratio or ellipticity and is usually specified in decibels (dB). If the axial ratio is near 0 dB, the antenna is said to be circular polarized. If the axial ratio is greater than 1 or 2 dB, the polarization is often referred to as elliptical.

Phased arrays antenna have long been used for both transmission and reception of signals waves in a variety of applications. One important parameter affecting the cost and performance of a phased array system are the number of elements and the inter-element spacing necessary to provide a desired steering response. In a traditional periodic array, an inter-element spacing of less than half the wavelength $\lambda/2$ is required to mitigate detrimental grating lobes. Because the main lobe width is dependent only on the spatial extent of the array, the generation of a narrow beam will usually require a large array and an inordinate number of individually driven elements.

Various methods have been proposed to relax the inter-element spacing requirement to create sparse arrays of fewer elements with reduced grating lobes. Because the grating lobes are a result of the periodicity of the element positions, they can be reduced through the use of a random or aperiodic distribution of elements, although at the expense of a reduced dynamic range. Others have proposed using different element patterns for transmit versus receive modes, or by relying on very short pulses.

SUMMARY

Issue continue to exist with phased array antennas and the manner in which they receive signals in an arbitrary polarization. For example, a linearly polarized phase array antenna operates in a linear manner and if a signal arrives at an angle thereto, then some of the signal is lost. If a linear phased antenna must be sensitive in both directions, then another signal must be generated that is orthogonal to the first. To create the two orthogonal signals, the feeds must be fed separately form a feed source. The present disclosure addresses this issue and other issues by providing an antenna element that is sensitive to arbitrary directions of signals and polarizations. Stated otherwise, a signal may arrive at any angle relative to the phased array of the present disclosure and the antenna of the present disclosure can observe the signal with only a single feed. More particularly, a circularly polarized phased array antenna of the present disclosure utilizes a single feed to receive linear polarizations and circular polarizations. Accordingly, the electronic circuitry associated with the antenna of the present disclosure is less than that of a phased array antenna having two feeds that are required to observe linear polarizations and circular polarizations.

Furthermore, issues continue to exist with phased array antennas that are circularly-polarized. Namely, they are inefficient at radiating in arbitrary linear polarizations using a low-cost printed circuit board integration approach. The present disclosure addresses these and other issues by providing a grating-lobe-free ultra-wide bandwidth circularly-polarized phased array sensitive to and capable of radiating in arbitrary linear polarizations. In one particular example, there are tightly-coupled (either capacitively or resistively coupled) frequency-independent radiating structures whose inter-element spacing is less than half wavelength ($\lambda/2$) at the highest frequency and whose excitation maintains a relative phase of 90 degrees between the terminals of each radiator. An extremely low profile antenna is created through the use of tightly coupled circularly polarized elements, which may be applied in the Command, Control, Communications, Computers, Intelligence, Surveillance and Reconnaissance (C4ISR) applications/areas amongst others. For example, the circularly polarized spiral apertures may be used for Signal Intelligence (SIGINT) and Electronic Attack (EA) applications that need to be sensitive to all polarizations with half the channels than are used in a similar bandwidth dipole based array.

In accordance with one aspect, an exemplary embodiment of the present disclosure may provide a array antenna comprising: a plurality of antenna unit cells arranged in rows and columns, or in another configuration such as in a circle; each unit cell from the plurality of unit cells including a circularly polarized radiator and a balun; a circuit element on the circularly polarized radiator that is coupled an adjacent unit cell in one of the row and the column, wherein the circuit element is one of a capacitor, a resistor, and an inductor; and a spacing distance between adjacent unit cells coupled via the circuit element that is at most half of a wavelength at a frequency maximum of the array antenna, wherein the spacing distance reduces likelihood of grating lobes. This exemplary embodiment or another exemplary embodiment may further provide wherein the circularly polarized radiator includes a first spiral element spiraling from a first end to a terminal second end and a second spiral element spiraling from a first end to a terminal second end, and further comprising: an excitation value of the antenna that maintains a relative phase of 90 degrees between the terminal ends of the first spiral element and the second spiral element. This exemplary embodiment or another exemplary embodiment may further provide a first substrate carrying the circularly polarized radiator, wherein the first spiral element and the second spiral element are arranged in an inter-spiraled configuration on the first substrate, and wherein the first spiral element tapers from the first end to the second end thereof; a cavity back defined by the first spiral element and the second spiral element. This exemplary embodiment or another exemplary embodiment may further provide wherein the balun is a double-y balun oriented orthogonally to the circularly polarized radiator; and an operational bandwidth that is at least 12:1 while maintaining an average performance efficiency of about −2 dB. This exemplary embodiment or another exemplary embodiment may further provide common mode rejection loops in electrical communication with the balun and a common ground strip. This exemplary embodiment or another exemplary embodiment may further provide a first pair of capacitors, wherein the circuit element is a first capacitor connected to the terminal second end of the first spiral element and a second capacitor is connected to the terminal second end of the second spiral element. This exemplary embodiment or another exemplary embodiment may further provide a second pair of capacitors including a third capacitor connected to the first spiral element orthogonally to the first capacitor and a fourth capacitor connected to the second spiral element orthogonally to the second capacitor. This exemplary embodiment or another exemplary embodiment may further provide wherein the first capacitor, the second capacitor, the third capacitor, and the fourth capacitor are all equal in capacitance. This exemplary embodiment or another exemplary embodiment may further provide a connection of the unit cell to a diagonally adjacent unit cell having a spacing distance that is at most half of a wavelength at a frequency maximum of the array antenna. This exemplary embodiment or another exemplary embodiment may further provide a first pair of resistors, wherein the circuit element is a first resistor connected to the terminal second end of the first spiral element and a second resistor is connected to the terminal second end of the second spiral element. This exemplary embodiment or another exemplary embodiment may further provide a second pair of resistors including a third resistor connected to the first spiral element orthogonally to the first resistor and a fourth resistor connected to the second spiral element orthogonally to the second resistor. This exemplary embodiment or another exemplary embodiment may further provide wherein the first resistor, the second resistor, the third resistor, and the fourth resistor are all equal in resistance. This exemplary embodiment or another exemplary embodiment may further provide a third pair of resistors including a fifth resistor connected to the first spiral element between the first resistor and the third resistor, and a sixth resistor connected to the second spiral element between the second resistor and the fourth resistor. This exemplary embodiment or another exemplary embodiment may further provide wherein the fifth resistor is configured at an angle of about 45 degrees between the first resistor and the third resistor. This exemplary embodiment or another exemplary embodiment may further provide a fourth pair of resistors including a seventh resistor connected to the first spiral element orthogonal to the fifth resistor opposite the third resistor, and an eighth resistor connected to the second spiral element orthogonal the sixth resistor opposite the fourth resistor. This exemplary embodiment or another exemplary embodiment may further provide wherein the fifth resistor, the sixth resistor, the seventh resistor, and the eighth resistor are all equal in resistance, and all different in resistance than the first resistor, the second resistor, the third resistor, and the fourth resistor. This exemplary embodiment or another exemplary embodiment may further provide a first differential transmission line of the balun connected with the first end of the first spiral element through a first substrate; and a second differential transmission line of the balun connected with the first end of the second spiral element through the first substrate. This exemplary embodiment or another exemplary embodiment may further provide an N-way power divider to feed a row of N unit cells, wherein N is any integer. This exemplary embodiment or another exemplary embodiment may further provide progressively lengthened transmission lines on the N-way power divider producing a progressive time delay across each port to feed the row of N unit cells in order to steer a main beam of the array antenna to a fixed angle along a plane parallel to the row.

In accordance with another aspect, an exemplary embodiment of the present disclosure may provide a method of operating a array antenna comprising: radiating energy from a circularly polarized radiator including two inter-spiraled elements fed from a balun, wherein the radiator is coupled with an adjacent radiator via a circuit element at a spacing distance between adjacent radiators that is at most half of a wavelength at a frequency maximum of the array antenna; reducing likelihood of grating lobes from the array antenna based, at least in part, on the spacing distance; maintaining an excitation value of the array antenna at a relative phase of 90 degrees between terminal ends of two inter-spiraled elements; and receiving a linearly polarize signal at the circularly polarized radiator.

BRIEF DESCRIPTION OF THE SEVERAL VIEWS OF THE DRAWINGS

Sample embodiments of the present disclosure are set forth in the following description, is shown in the drawings and is particularly and distinctly pointed out and set forth in the appended claims.

Similar numbers refer to similar parts throughout the drawings.

DETAILED DESCRIPTION

Figure 1:
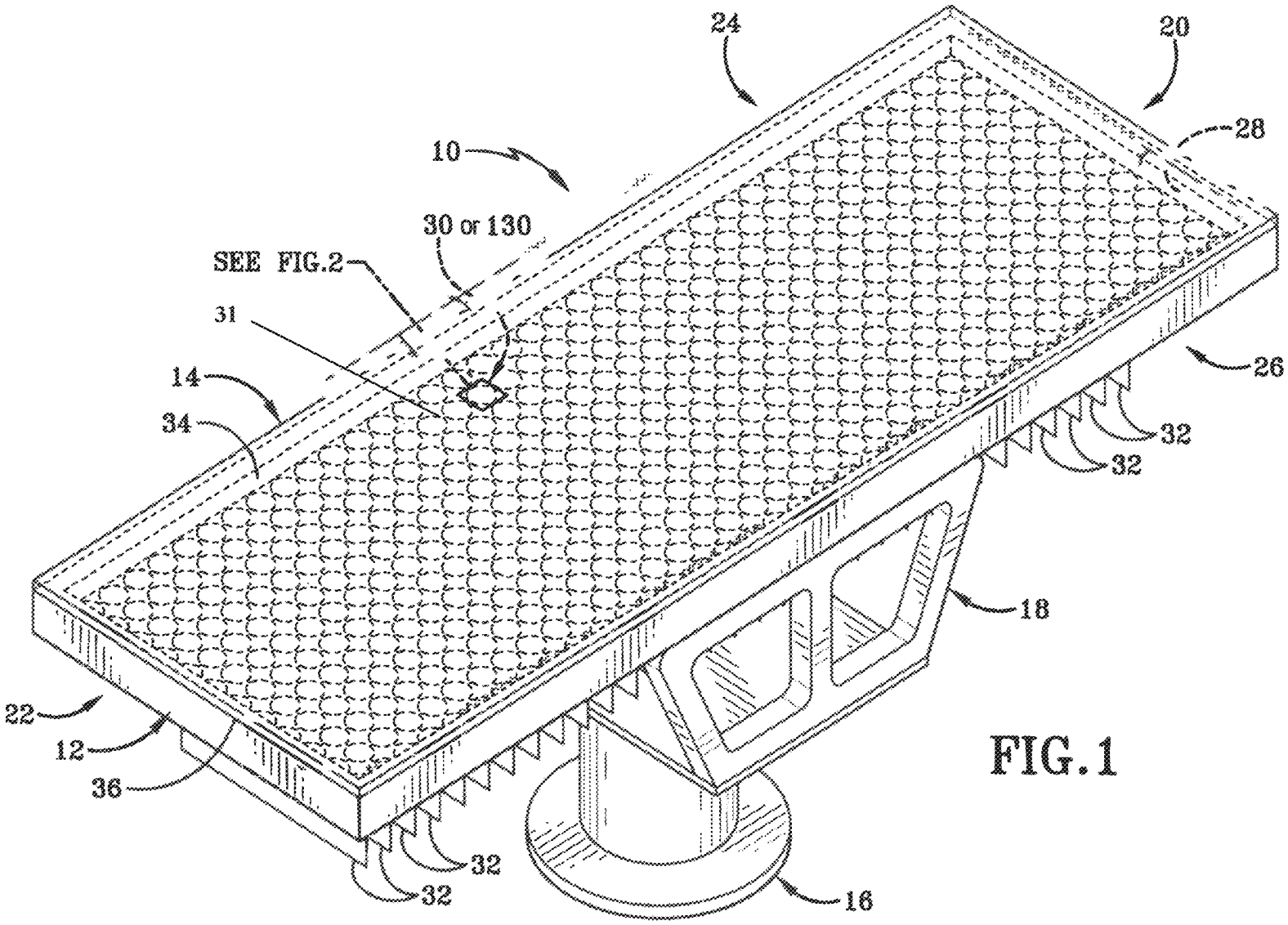
FIG. 1 is a schematic perspective view of an antenna array having a plurality of antenna unit cells arranged in rows and columns according to one embodiment.

Referring to FIG. 1, a grating-lobe-free ultra-wide bandwidth circularly-polarized array antenna is shown generally at 10. FIG. 1 depicts that the antenna 10 may include a frame 12, a cover 14, a mount 16, and a structural connector 18 connecting the frame 12 to the mount 16.

The frame 12 includes a first end 20 opposite a second end 22 defining a longitudinal direction therebetween. The frame 12 includes a first side 24 opposite a second side 26 defining a transverse direction therebetween. The frame 12 includes a top opposite a bottom defining a vertical direction therebetween. The frame 12 may be a substantially rigid member formed from any one of a variety or plurality of materials that impart rigidity to the structure to the frame 12 without impinging or degrading transmitted or received signals effectuated by the antenna 10. The frame 12 defines a central opening 28 between the first end 20 and the second end 22 and between the first side 24 and the second side 26. Within the opening 28 of the frame 12, a plurality of antenna elements, which may also be referred to as one or more unit cells, are disposed and supported by the frame 12. Each on one of the unit cells may be denoted as 30 or 130 depending on the type of the unit cell. For example, a first embodiment unit cell 30 is detailed in FIGS. 2-12 and a second embodiment unit cell 130 is detailed in FIGS. 13-20.

The cover 14 covers each of the unit cells 30 or 130 within the opening 28 of the frame 12. In one particular embodiment, the cover 14 includes a first major surface 34 opposite a second major surface 36. The second major surface 36 of cover 14 is closely adjacent the top 28 of the frame 12. In one particular embodiment, cover 14 may be directly mounted through mechanical or other types of fasteners to secure the cover 14 to the frame 12. Furthermore, the first major surface 34 and the second major surface 36 may include a substantially similar perimeter as that of the frame 12. However, it is entirely possible for the cover 14 to have alternative shapes provided that any resultant cover 14 protects each one of the unit cells 30 within the opening 28 of the frame 12. Furthermore, the cover 14 should have an optimized permittivity to ensure that the transmission and reception of radar signals are not interfered with or degraded by the cover 14.

In one particular embodiment, the cover 14 is a radome which provides a structural and weatherproof enclosure for the frame 12 to protect the antenna. The radome cover 14 is constructed of a material that minimally attenuates the electromagnetic signal transmitted or received by the antenna to be effectively transparent to radio waves. The first major surface 34 in one particular embodiment may be flat and planar. However, it is entirely possible for at least one of the major surfaces of the radome cover 14 to be either concave or convex.

The mount 16 may be any structural member that is used to support the frame 12. In one particular embodiment, the mount 16 may include a cylindrical sidewall extending between annular flanges at the terminal ends of the cylindrical sidewall that are substantially orthogonal to a vertical axis thereof. One of the flanges may include longitudinally aligned outer edges to which the structural connector 18 extends between the flange and the frame 12.

Two embodiments of the present disclosure are provided and will be discussed respectively in turn. The first embodiment of the present disclosure provides the plurality of unit cells 30 that are capacitively coupled to adjacent unit cells 30 in orthogonal directions relative to a central vertical axis of the unit cell 30. A second embodiment of the present disclosure provides unit cells 130 that are resistively coupled to adjacent orthogonally adjacent and diagonal unit cells. In each embodiment, the plurality of unit cells 30, 130 may be fed with a Wilkinson power splitter or Wilkinson power divider 32.

The plurality of unit cells 30, 130 are arranged in rows and columns within the opening 28 of the frame 12. Number of rows and columns of unit cells 30, 130 may vary depending upon the size and operating parameters required of the antenna 10. Furthermore, the shape of the arranged unit cells 30, 130 does not need to be rectangular as presented in FIG. 1. The arranged unit cells 30, 130 may form a different shape such as a circle, square, cube, or any other geometric configuration as the case may need. Regardless of the overall shape of the array, the arranged unit cells 30, 130 should be tightly coupled through reactive elements or circuit elements, as will be described in greater detail below.

Figure 2:
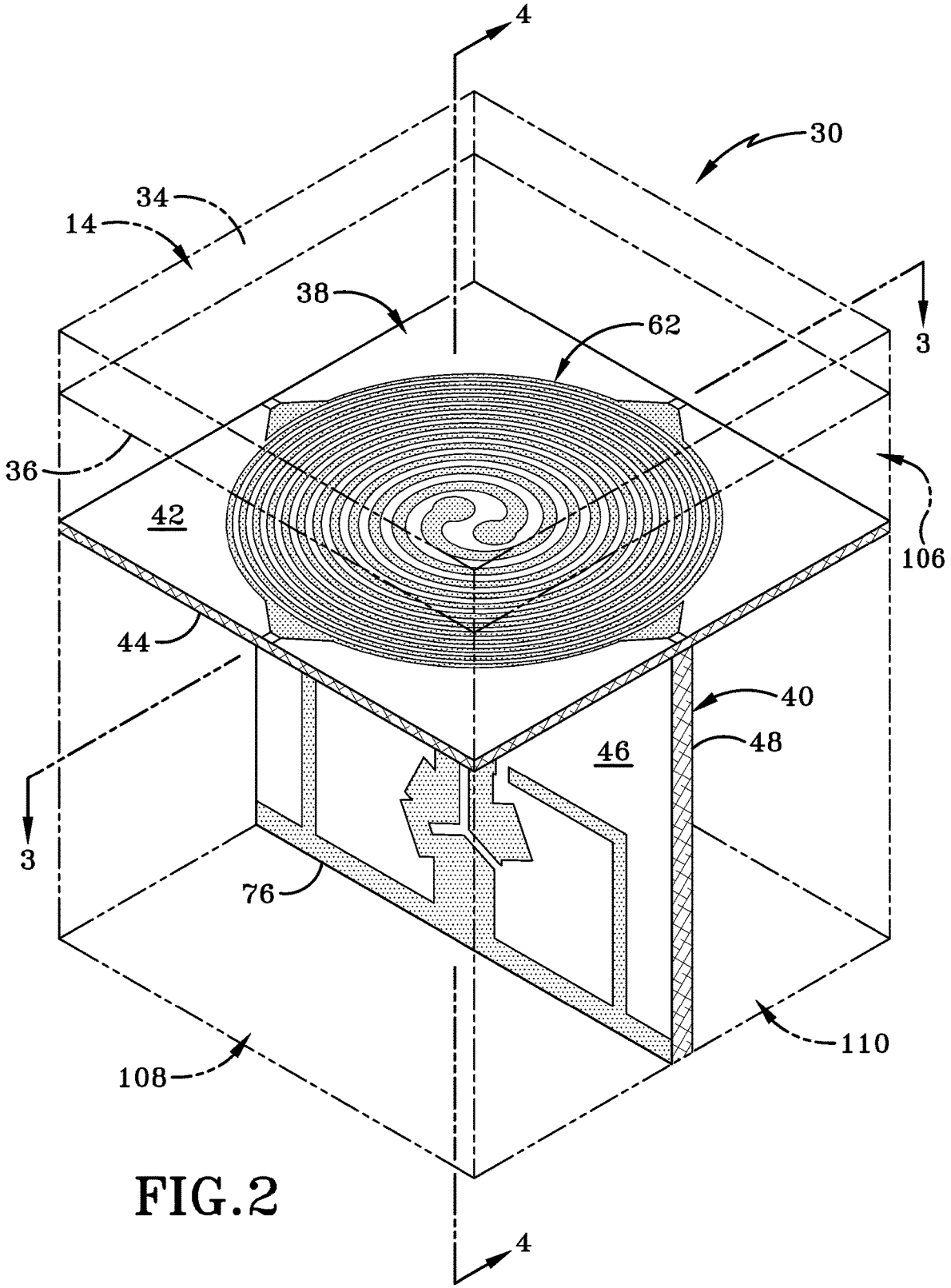
FIG. 2 is a perspective view of a first embodiment antenna unit cell.
Figure 3:
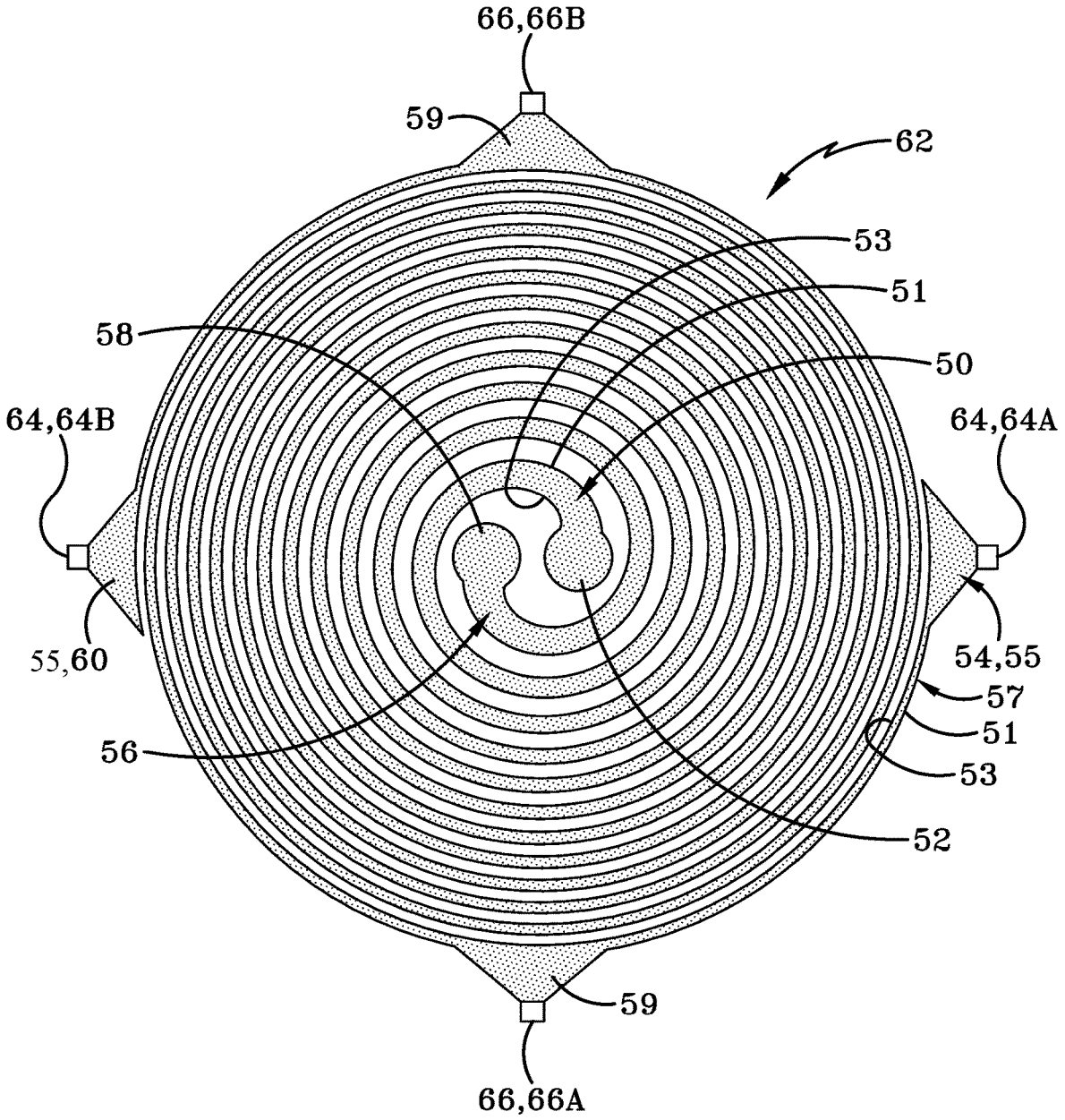
FIG. 3 is a top plan view of a radiator of the first embodiment unit cell taken along line 3-3 in FIG. 2.
Figure 4:
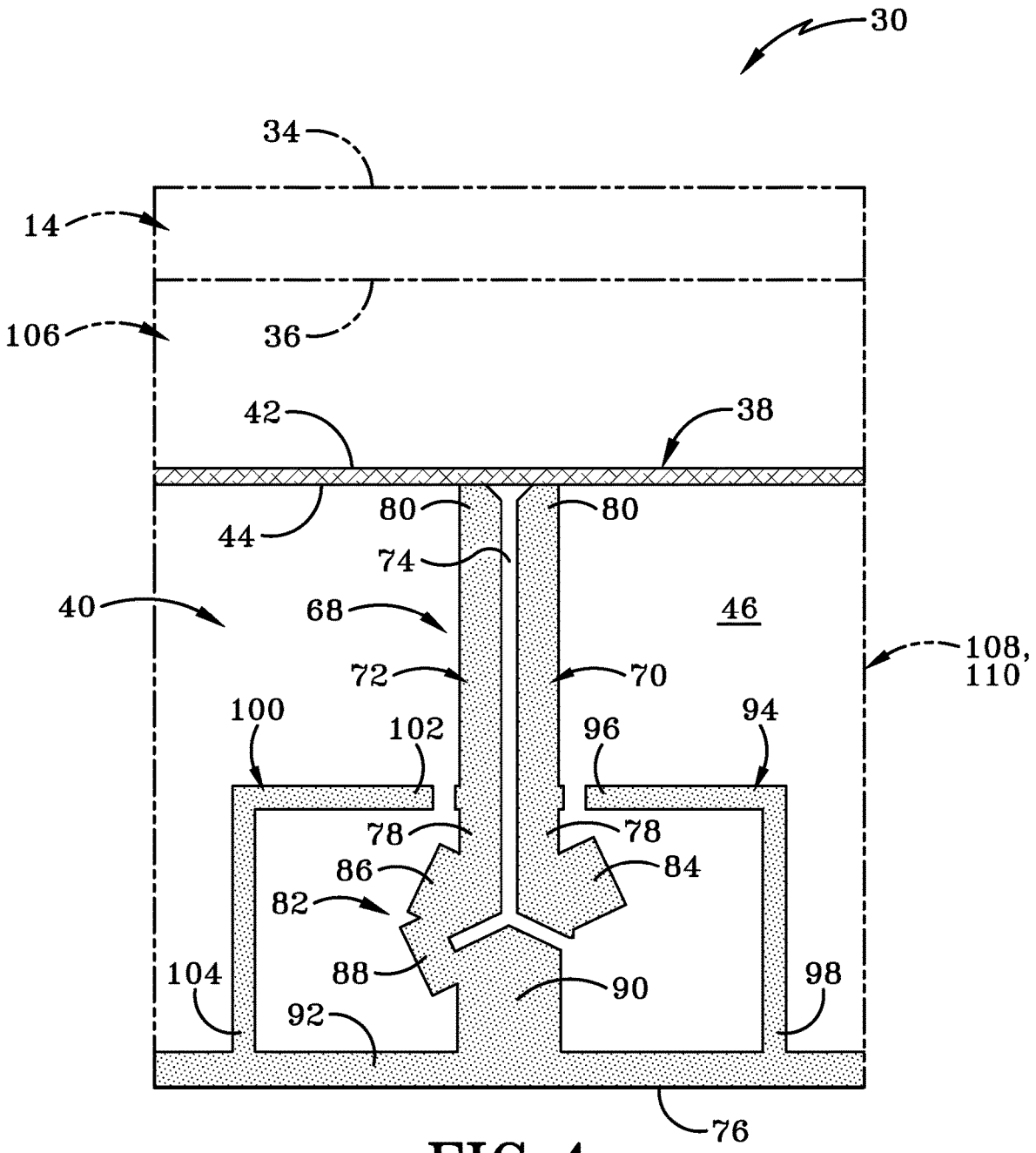
FIG. 4 is a side elevation view of a double-y balun on the first embodiment unit cell taken along line 4-4 in FIG. 2.

FIG. 2, FIG. 3, and FIG. 4 depict an exemplary unit cell 30 in accordance with one embodiment of the present disclosure. Unit cell 30 includes capacitors that couple a spiral radiator with orthogonally adjacent unit cells 30 in the antenna array 10. The unit cell 30 includes a horizontal first substrate 38 and a vertical second substrate 40. The first substrate 38 and the second substrate 40 may be connected together to define a T-shaped configuration when viewed in longitudinal cross-section. In one particular embodiment, the first substrate 38 includes an upwardly facing top or first surface 42 and a downwardly facing bottom or second surface 44. The vertical second substrate 40 extends vertically downward from a substantially rigid connection with the bottom surface 44 of horizon first substrate 38. Vertical second substrate 40 includes a first side surface 46 opposite a second side surface 48. The first side surface 46 of the vertical second substrate 40 adjoins the bottom surface 44 of the horizontal first substrate 38 at a substantially right angle. Similarly, the second side surface 48 of the vertical second substrate 40 adjoins the bottom surface 44 of the horizontal first substrate 38 at a substantially right angle. One or more conductive elements, as will be described in greater detail below, are connected to the respective substrates 38, 40. In one particular embodiment, the first substrate 38 and the second substrate 40 are printed circuit boards (PCBs).

FIG. 2 (and FIG. 12) depict that each unit cell 30 or 130 may be structurally supported with a foam having a permittivity that does not inhibit or degrade the signals radiated from the radiator 62. A first layer of foam 106 is positioned above the first surface 42 of the horizontal first substrate 38. A second portion of foam 108 is positioned below the second surface 44 of the horizontal first substrate 38 and is offset from the first surface 46 of the vertical second substrate 40. A third portion of foam 110 is positioned below the second surface 44 of the horizontal first substrate 38 and offset from the second surface 48 of the vertical second substrate 40. In one particular embodiment, the foam 106, 108, 110 has a permittivity of about one. However, the permittivity of the foam may vary depending upon the application's specific needs implemented by the antenna 10. The permittivity of the foam may be optimized utilizing modeling software that would enable the antenna 10 to determine different perceptivities that could be applied to accomplish the tightly-coupled frequency-independent radiating unit cells 30 or 130 that are spaced less than half a wavelength at the highest frequency from an adjacent unit cell. In one example, an exemplary foam 106, 108, 110 is commercially available for sale as ROHACELL, however, any other foam with a permittivity close to that of air is possible. The foam 106, 108, 110 is intended to absorb vibration in airborne applications and the properties for each foam 106, 108, 100 can vary.

As depicted in FIG. 3, at least one conductive spiral element is connected to the top surface 42 of the horizontal first substrate 38. In one particular embodiment, a first conductive spiral element 50 extends from a first end 52 to a terminal second end 54. The first end 52 is associated with the general center of the spirally wound element and the terminal second end 54 is the radial outermost portion of the spirally wound element. The conductive spiral element 50 extends in an electrically conductive manner between the first end 52 and the second end 54. A second conductive spiral element 56 may be spirally wound in an alternate manner on the top surface 42 of the horizontal first substrate 38. The second spirally wound conductive spiral element 56 may extend between a first end 58 and a terminal second end 60. In one particular embodiment, the first and second spirally wound conductive spiral elements 50, 56 may be referred to collectively as the radiator 62 or the radiating element 62.

Each spiral element 50, 56 radiator may be cavity-backed. The cavity behind each spiral element 50, 56 of the radiator 62 overcomes a challenge of typical spiral radiators or spiral antennas on a ground plane because the radiation goes in both directions (i.e., up above the spiral and down below the spiral). Then, the radiation reflects off the ground plane and interferes with the transmission signal or the signal being received. Thus, the non-cavity spiral elements can limit the frequency band of operation because the gain will be low enough that the array antenna will not output sufficient radiation. This is due to the fact that non-cavity spiral elements of the radiator reflect waves back into the feed in the opposite direction of oppositely polarized fields that results in interference that minimizes the circular polarization. Thus, the cavity-backed spiral elements 50, 56 cure these concerns to reduce the waved reflected back into the feed.

The radiator 62 may include circuit elements (i.e., capacitor, resistor, or inductors) to connect to an adjacent unit cell. In one particular example, unit cell 30 includes four capacitors, wherein one capacitor from the four couples the radiator 62 to an adjoining radiator on another unit cell 30. A spacing distance 31 between adjacent unit cells 30 coupled via the circuit element, which in this case is a capacitor, is at most half of a wavelength ($\lambda/2$) at a frequency maximum of the array antenna, wherein the spacing distance 31 eliminates grating lobes.

Within continued reference to FIG. 3, a first pair of capacitors 64 are positioned at the respective terminal ends 54, 60 of the first spiral element 50 and the second spiral element 56. More particularly, a first capacitor 64A is electrically connected with the terminal second end 54 of the first conductive spiral element 50 and a second capacitor 64B is connected with the terminal second end 60 of the second conductive spiral element 56. The capacitors 64A, 64B that define the first pair of capacitors 64 have the same capacitance value. A second pair of capacitors 66 are positioned orthogonal to the first pair of capacitors 64. A third capacitor 66A is electrically connected to the first conductive spiral element 50 intermediate the first end 52 and the terminal second end 54, and the third capacitor 66A is orthogonally aligned or orthogonal to the first capacitor 64A and the second capacitor 64B. A fourth capacitor 66B is connected to the second conductive spiral element 56 intermediate the first end 58 and the terminal second end 60. The fourth capacitor 66B is orthogonal to the first capacitor 64A and orthogonal to the second capacitor 64B. In one particular embodiment, the first capacitor 64A is diametrically opposite the second capacitor 64B and the third capacitor 66A is diametrically opposite the fourth capacitor 66B on each respective unit cell 30. In one particular embodiment, the pair of second capacitors 66 have the same capacitance value as the first pair of capacitors 64.

With continued reference to FIG. 3, each of the spiral elements 50, 56 includes a spiraling first edge 51 and a spiraling second edge 53. With respect to the first spiral element 50, a first edge 51 is spaced apart from a second edge 53 and a width of the radiating conductive element of the spiral element 50 is between the first edge and the second edge 53. As the spiral element 50 winds in a circular manner from the first end 52 to the second end 54, the width of the element tapers or narrows. Stated otherwise, the width of the radiating spiral element 50 between the first edge 51 and the second edge 53 is wider or greater at the first end 52 than it is proximate the second end 54. Note that the second end 54 may have a triangular region 55 that is wider than the first end 52; however, a narrow region 57 adjacent the triangular region 54 has a width that is smaller between the first edge 51 and the second edge 53. There may be an opposing triangular region 55 at the end 60 of spiral element 56 opposite the first triangular region 55 at the end 54 of the first spiral element 50. Furthermore, the first and second radiating spiral elements 50, 56 may be inter-spiraled. The term "inter-spiraled" refers to the configuration depicted in FIG. 3 in which a portion of the first spiral element 50 is located between or disposed intermediate two portions of the second radiating element 56 along a common radius. Each of the spiral elements 50, 56 may include a second triangular region 59 may be coupled and form a portion of the spiral conductor and be located orthogonal relative to the first triangular region 55. There may be a further triangular region opposing the second triangular region 59.

FIG. 4 depicts a balun 68 attached to the vertical second substrate 40. In one particular example, the balun 68 is a double-y balun attached to the first side surface 46 of the vertical second substrate 40. The balun 68 includes a first differential transmission line 70 and a second differential transmission line 72. The first and second differential transmission lines 70, 72 are spaced apart and generally parallel defining a gap 74 therebetween. The first and second differential transmission lines 70, 72 are connected to the substrate 40, and in one particular embodiment, extend in the vertical direction from the bottom end 76 of the vertical second substrate 40. Each differential transmission line 70, 72 includes a lower end 78 and an upper end 80. The upper ends 80 of the first differential transmission line 70 and the second differential transmission line 72 extend through the horizontal first substrate 38 and are electrically connected with the respective first ends of the first spiral element 50 and the second spiral element 56. More particularly, the upper end 80 of the first differential transmission line 70 is electrically connected with the first end 52 of the first spiral radiating element 50 through substrate 38. The upper end 80 of the second differential transmission line 72 is electrically connected with the first end 58 of the second spiral radiating element 56 through substrate 38.

Near the lower end 78 of each transmission line 70, 72 is a tuning stub 82. The tuning stub 82 includes a first stub 84 connected with the first differential transmission line 70 and a second stub 86 connected with the second differential transmission line 72, and a third stub 88 connected with the second differential transmission line 72 and the second stub 86. The tuning stub 82 is positioned and closely proximate the lower end 78 of each of the respective differential transmission lines 70, 72. A signal input 90 is in operative communication with the tuning stub 82 adjacent the third stub 88. The signal input 90 is configured to receive an input signal there along from a signal source. In one particular embodiment, the signal source may be fed through the power divider 32. The power divider 32 may be an N-way Wilkinson splitter, where N is any integer, such as two, three, four, five, six, seven, eight, nine, ten, or more. The tuning stub 82 and the signal input 90 are electrically conductive elements that are integrally formed with the second differential transmission line 72. Accordingly, tuning stub 82 and the signal input 90 are implanted on the first surface 46 of the vertical second substrate 40. The tuning stub 82 on the balun may include two shorts and two opens that are used to tune the balun 68.

A common ground strip 92 extends along the width of the vertical second substrate 40 and is electrically connected between each one of the plurality of unit cells forming a row on the antenna 10. The common ground strip 92 is electrically connected adjacent the input 90 so as to provide a ground for the circuit of the antenna array 10.

A first rejection loop 94 includes a first end 96 closely adjacent the first differential transmission line 70 and a second end 98 coupled with the common ground strip 92. A second rejection loop 100 includes a first end 102 proximate the second end differential transmission line 72 and a second end 104 coupled with the common ground strip 92. The rejection loops 94, 100 remove scan anomalies. Thus, when the phase is changed between adjacent radiators 62 (or 162, discussed infra), the rejection loops 94, 100 remove the inefficiencies, such as the spikes in the VSWR.

Figure 5:
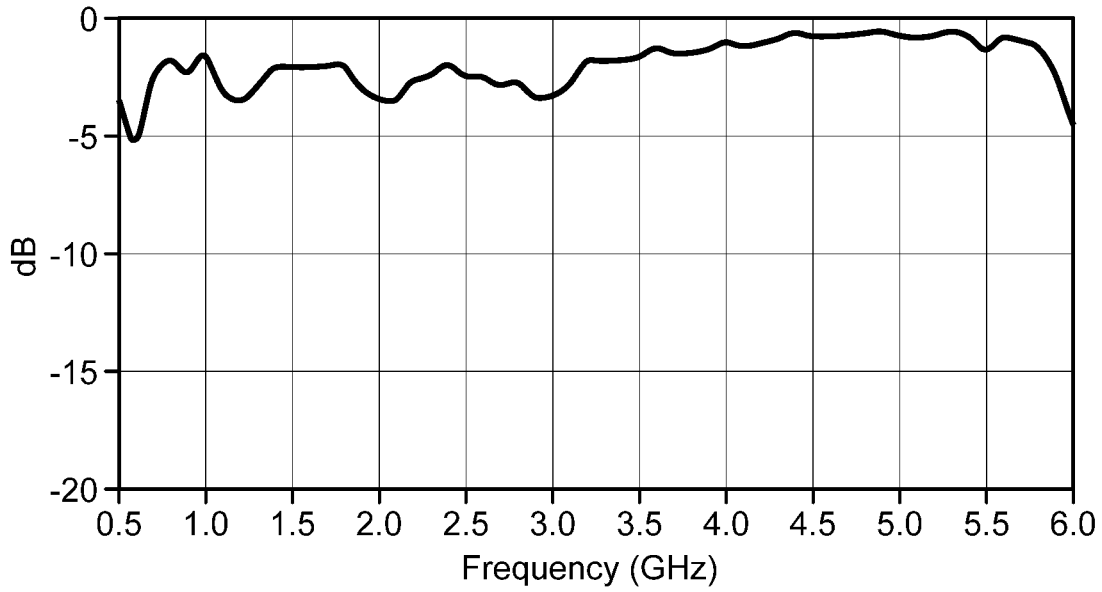
FIG. 5 is a unit cell efficiency graph of the antenna unit cell of FIG. 2 for frequencies ranging from 0.5 GHz to 6 GHz.

FIG. 5 is a graph depicting the efficiency of unit cell 30 as modeled by a floquet analysis. The unit cell efficiency has been simulated to be between −5 and 0 dB between a frequency of 0.5 gigahertz (GHz) to 6 gigahertz (GHz). The floquet analysis simulates the subject unit cell on an infinite array environment that is widely used by antenna analysis systems. The unit cell efficiency measures, out of the power input at the input port, how much power is radiated out to the output port of the unit cell.

Figure 6:
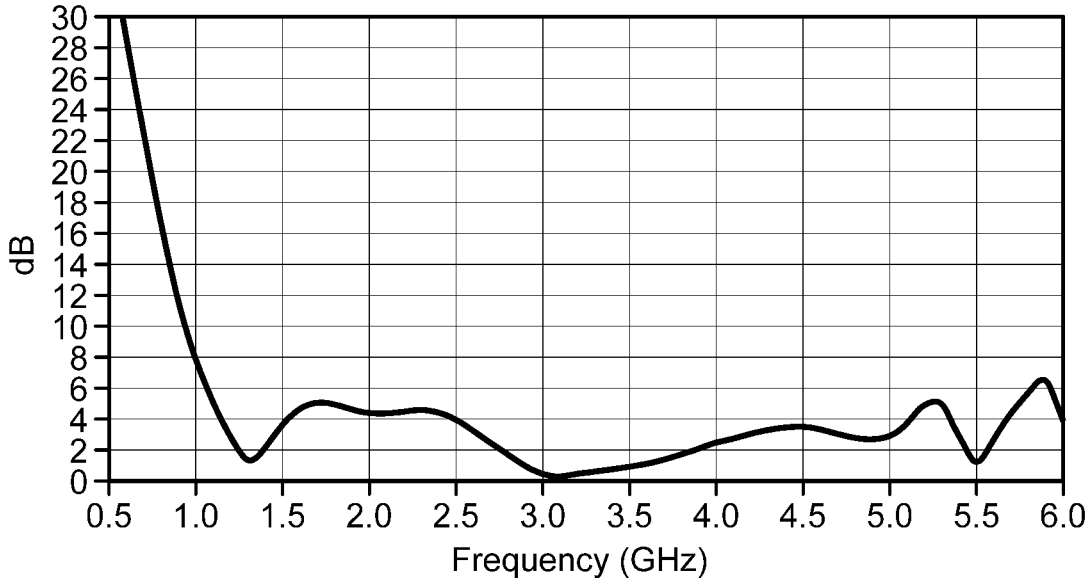
FIG. 6 is a unit cell axial ratio of the graph of the antenna unit cell of FIG. 2 for frequencies ranging from 0.5 GHz to 6 GHz.

FIG. 6 depicts a graph of the simulated unit cell axial ratio. The axial ratio is a measure of circular polarization representing the ratio between the orthogonal fields. Stated otherwise, the linearly polarized field is measured and another linearly field that is 90 degrees out of phase from the first. The unit cell axial ratio finds the ratio between these two fields. In a perfectly circularly polarized case, the unit cell axial ratio is 0 dB. A ratio of 0 dB refers to the fact that there is no difference between the orthogonally polarized fields. As the circular polarization worsens, the axial ratio increases. A typical figure for an axial ratio is at least less than 6 dB. In some other instances, an axial ratio less than 3 dB is required. Thus, as shown in FIG. 6, the unit cell 30 axial ratio for the double-Y balun integration with capacitively coupled spiral radiators is less than 6 dB for frequencies between about 1 GHz and 6 GHz.

Figure 7:
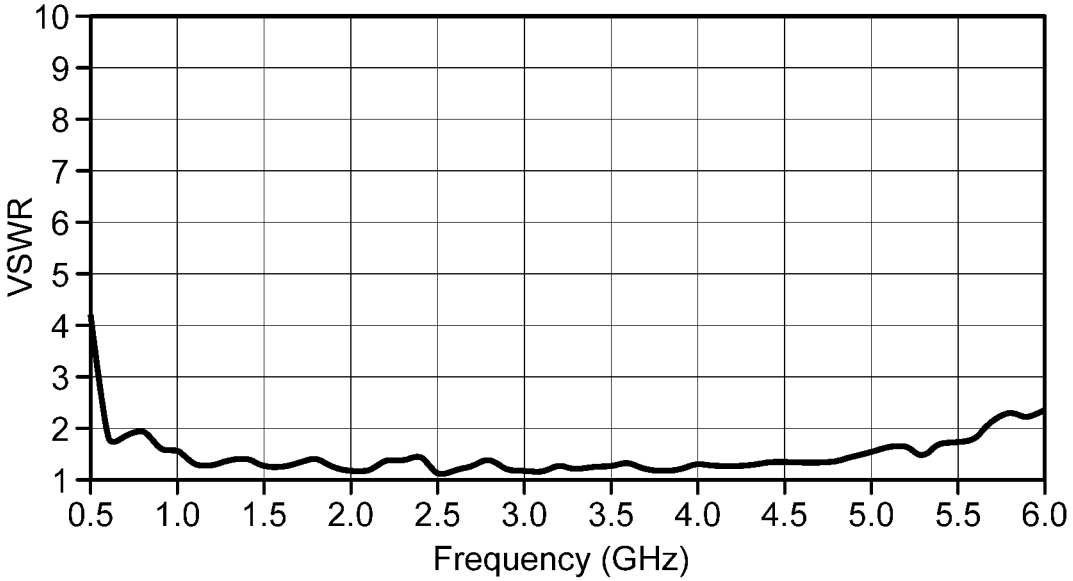
FIG. 7 is a unit cell 50-Ohm input match graph for the antenna cell unit of FIG. 2 for frequencies ranging from 0.5 GHz to 6 GHz.

FIG. 7 depicts the simulated unit cell 50 Ohm input match. As is well known, a 50 Ohm input match is typically required as it is a standard connection for an antenna array. FIG. 7 is a graph of the voltage standing wave ratio (VSWR) over a frequency bandwidth. The VSWR is a ratio of how much power is reflected back into the feed. A low VSWR is associated with good antenna performance as it reduces the amount of signal reflected back which, if that signal is great, can degrade performance of other electrical components in the antenna system. The VSWR is also a figure of how much power input into the antenna is radiating out into free space. For receive-only antennas, it is preferable to have the VSWR be less than 4:1. For a transmit-only antenna or a transmit and receive antenna, the VSWR should be less than 2:1. As depicted in FIG. 6, the antenna of the present disclosure for having the double-y balun integration with capacitively coupled spiral radiators produces a VSWR of less than 2:1 over the bandwidth from approximately 0.5 GHz to about 5.5 GHz.

Figure 8:
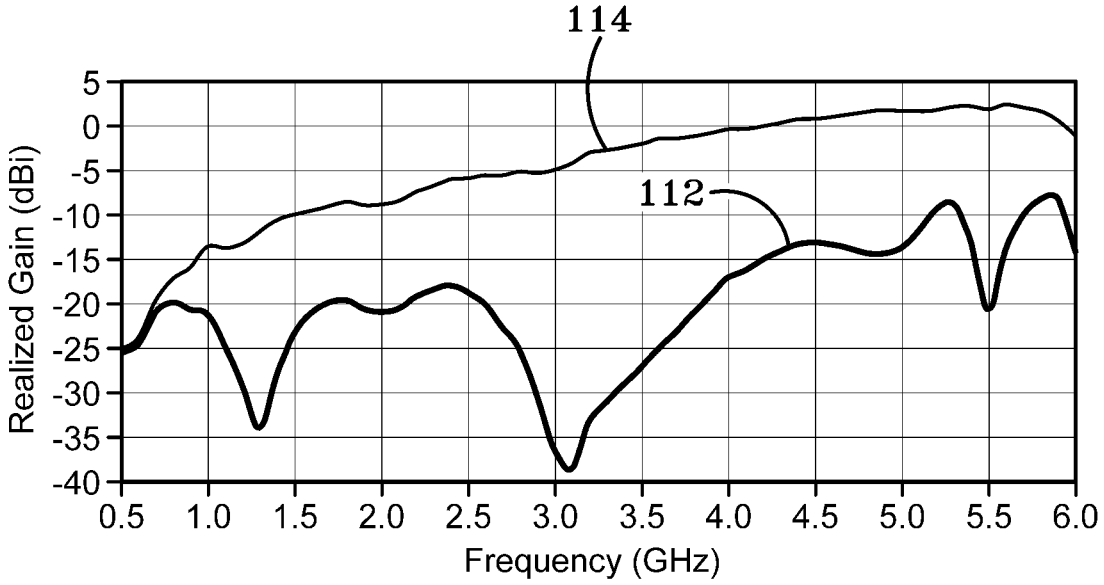
FIG. 8 is a unit cell right-handed and left handed circularly polarized gain at the boresight of the antenna cell unit of FIG. 2 for frequencies ranging from 0.5 GHz to 6 GHz.

FIG. 8 depicts a simulated graph of the unit cell 30 right-handed and left-handed circularly polarized gain at the bore site. In the graph of FIG. 8, the unit cell 30 has a right-handed circular polarization gain, which refers to how directional the antenna element is operating. As shown in FIG. 8, the right-handed circular polarization gain 114 is in a range from about −15 dBi to about 0 dBi over the frequency from 1 GHz to 6 GHz. At a frequency less than 1 GHz, the right-handed circular polarization gain 114 and the left-handed circular polarization gain 112 combine which is indicative of linear polarization. Thus, when reviewing the graph of FIG. 8 from a highest frequency to a lower frequency (i.e., 6 GHz down to 0.5 GHz), the unit cell 30 begins as circular polarized and then transitions into linear polarization when the gain of the left-handed circular polarization gain 112 curve and the right-handed circular polarization gain 114 curve begin to match. Since the antenna element of the present disclosure is operating in right-handed circular polarization, the right-handed circular polarization is relatively uniform and smooth along its curve. The left-handed circular polarization is cross-polarized relative to the right-handed circular polarization. This is generated from reflections in the spirals and also from the phase not tracking the correct offset (i.e., the 90 degree phase offset) with the frequency. As the curve of the left-handed circular polarization gain 112 increases towards the right-handed circular polarization curve, this means that the circular polarization itself is getting worse. This means that the phase is not 90° off or the amplitude is off or both.

Figure 9:
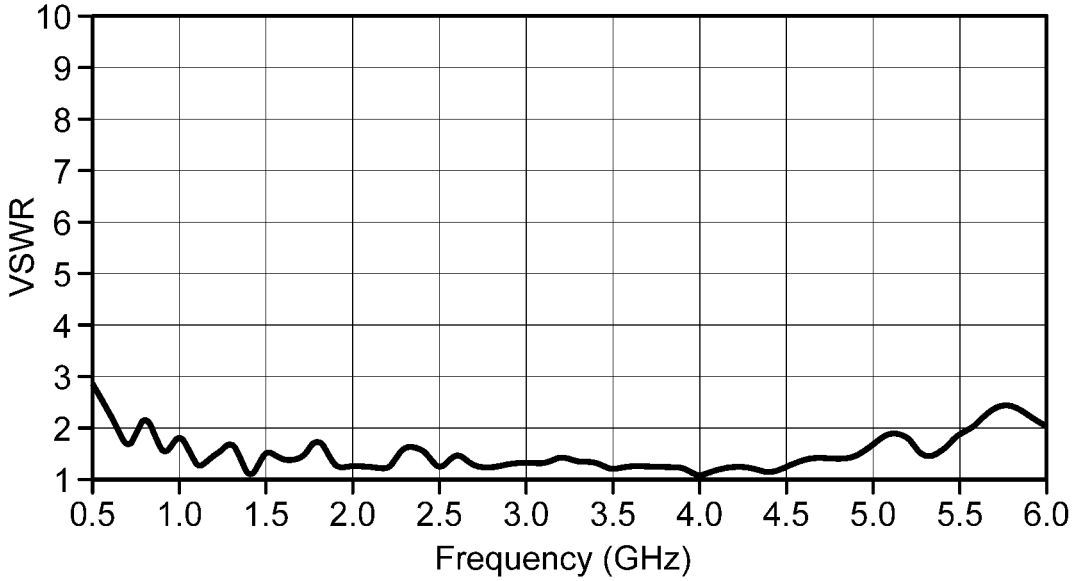
FIG. 9 is a unit cell 50-Ohm input match graph for the antenna cell unit of FIG. 2 coupled with an 8-way power divider for frequencies ranging from 0.5 GHz to 6 GHz.

FIG. 9 represents the simulated cascaded 50 OHM input match of the unit cell 30 when it is attached with the power divider 32. In this particular model, the power divider 32 is an 8-way Wilkinson splitter cascaded with the unit cell 30. The VSWR is less than 2 between 1 GHz and 5.5 GHz when the unit cell 30 is connected with a power divider 32 that is embodied as an 8-way Wilkinson splitter.

Figure 10:
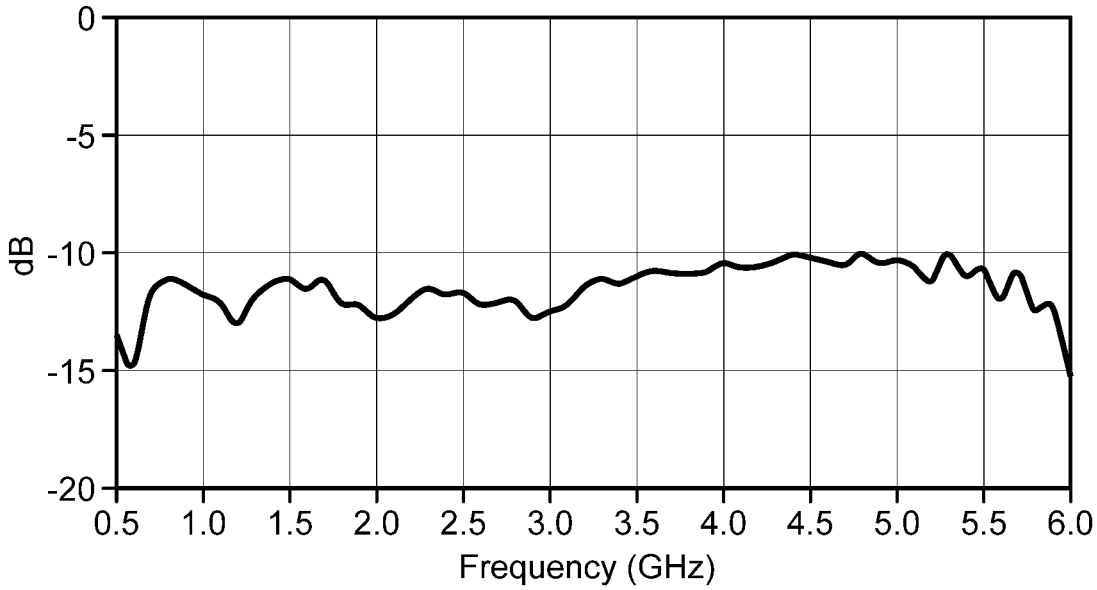
FIG. 10 is a unit cell efficiency graph of the antenna unit cell of FIG. 2 coupled with an 8-way power divider for frequencies ranging from 0.5 GHz to 6 GHz.

FIG. 10 is a graph depicting the efficiency of unit cell 30 as modeled by a floquet analysis coupled with a cascaded power divider 32. The unit cell efficiency has been simulated to be between −10 and −15 dB between a frequency of 0.5 gigahertz (GHz) to 6 gigahertz (GHz). The floquet analysis simulates the subject unit cell on an infinite array environment that is widely used by antenna analysis systems. The unit cell efficiency measures, out of the power input at the input port, how much power is radiated out to the output port of the unit cell.

Figure 11:
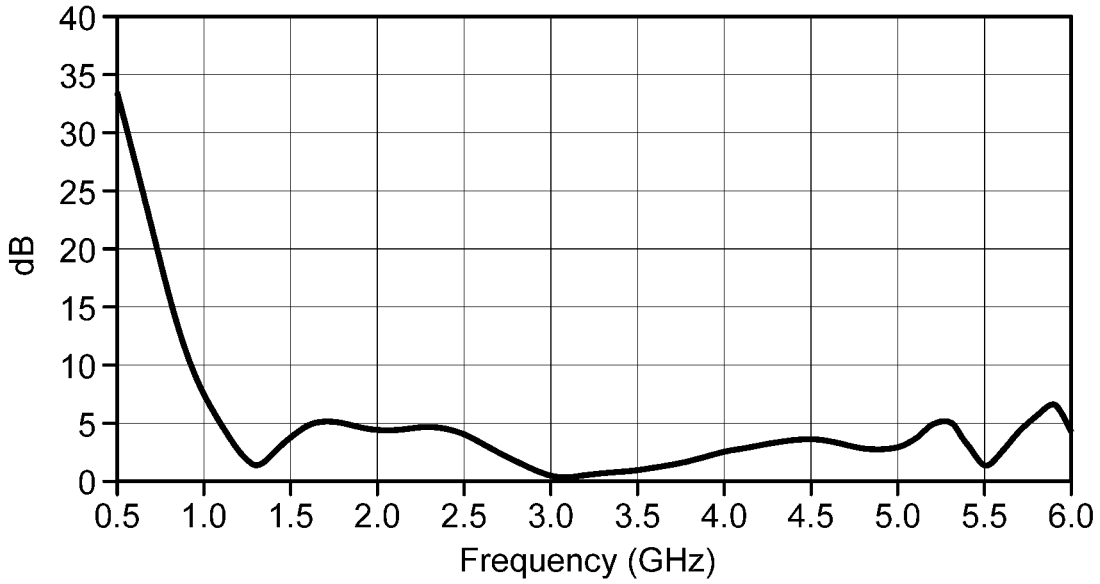
FIG. 11 is a unit cell axial ratio of the graph of the antenna unit cell of FIG. 2 coupled with an 8-way power divider for frequencies ranging from 0.5 GHz to 6 GHz.

FIG. 11 represents that the cascaded axial ratio of the unit cell 30 connected with the power divider 32 embodied as an 8-way Wilkinson splitter maintains a ratio power factor (pf) less than about 5 dB between 1 GHz and 5.5 GHz. This axial ratio is a measure of circular polarization representing the ratio between the orthogonal fields. Recall, in a perfectly circularly polarized case, the unit cell axial ratio is 0 dB. A ratio of 0 dB refers to the fact that there is no difference between the orthogonally polarized fields. As the circular polarization worsens, the axial ratio increases. A typical figure for an axial ratio is at least less than 6 dB. In some other instances, an axial ratio less than 3 dB is required. Thus, as shown in FIG. 11, the unit cell 30 axial ratio for the double-Y balun integration with capacitively coupled spiral radiators connected with the power divider 32 embodied as an 8-way Wilkinson splitter maintains a ration of less than 6 dB for frequencies between 1 GHz and 6 GHz.

Figure 12:
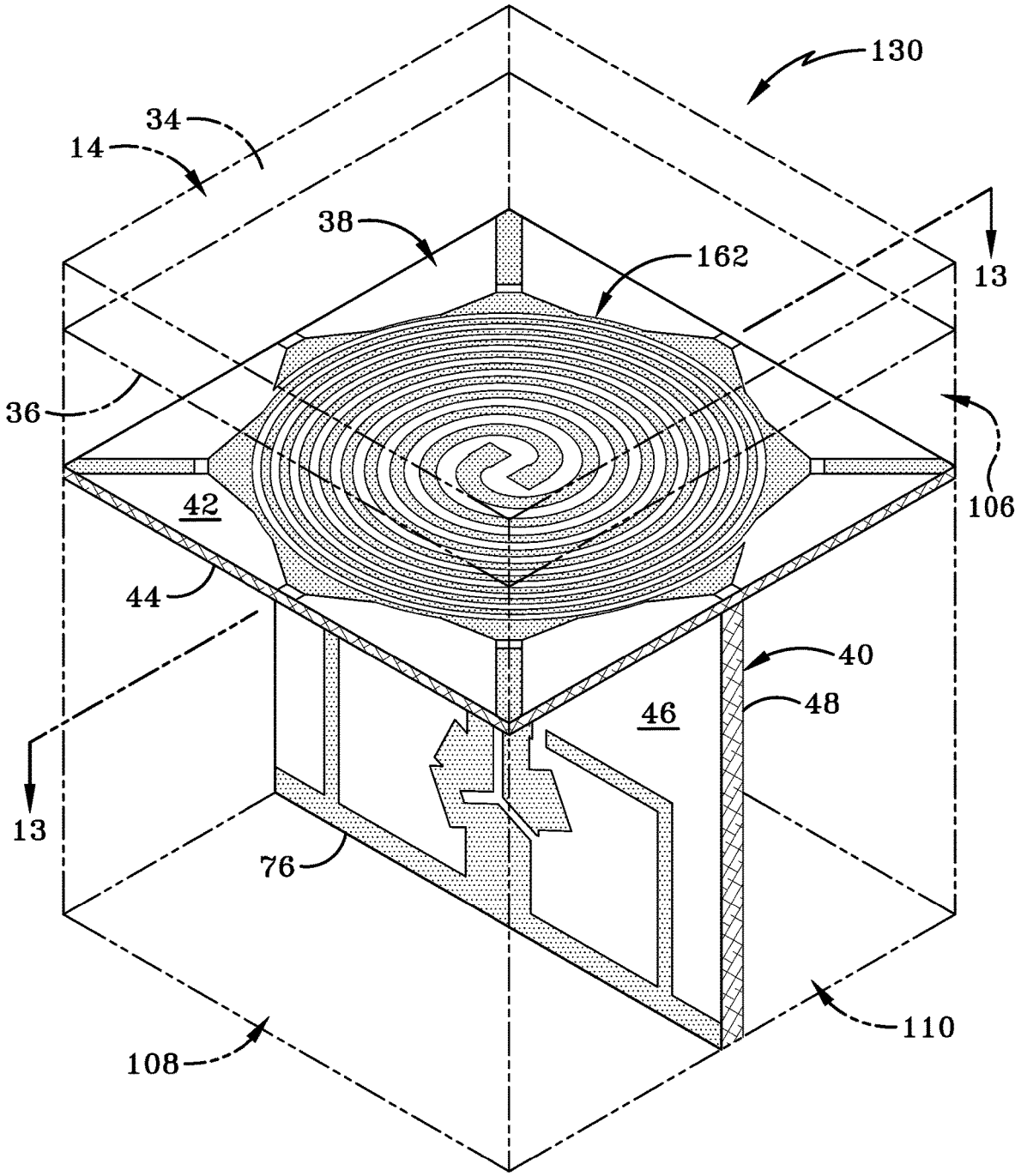
FIG. 12 is a perspective view of a second embodiment antenna unit cell.
Figure 13:
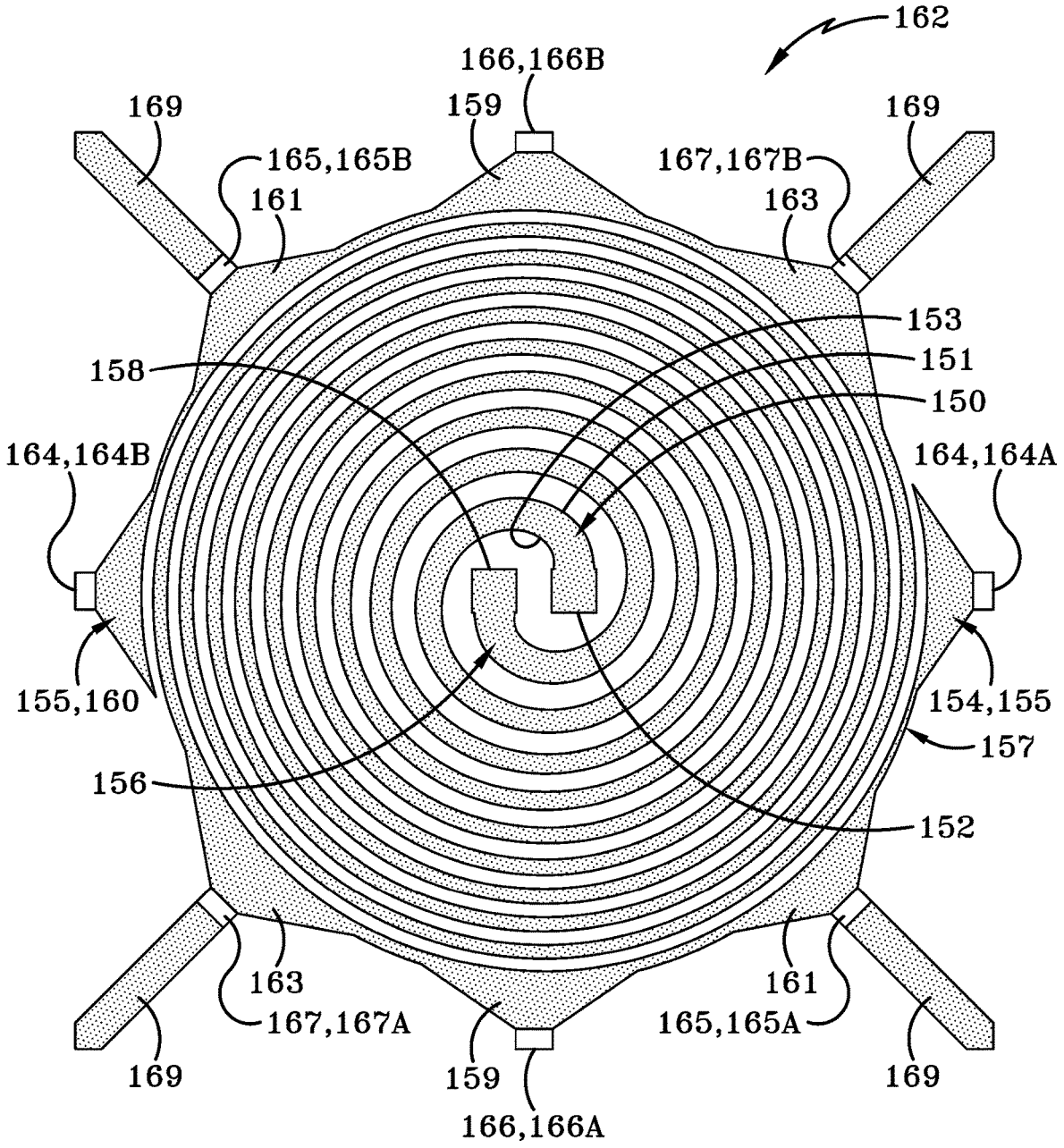
FIG. 13 is a top plan view of a radiator of the second embodiment unit cell taken along line 13-13 in FIG. 12.

FIG. 12 and FIG. 13 depict the second embodiment unit cell 130 having the balun 68 and a radiator 162. Radiator 162 includes a first spiral radiating conductive element 150 extending from a first end 152 to a terminal second end 154 between side edges 151 and 153. The first end 152 of the first spiral element 150 is electrically connected with the first end 80 of the first differential transmission line 70. The first spiral element 150 includes a first triangular region 155 at the terminal second end 154 and a second triangular region 159 located orthogonal to the first triangular region 155. The first spiral element 150 further includes a narrowed end region 157 closely adjacent the terminal second end 154 establishing that the first spiral element 150 tapers or narrows from the first end 152 to the terminal second end 154 between first edge 151 and second edge 153. The radiator 162 further includes a second spiral element 156 extending between a first end 158 and a second end 160. Similar to the first embodiment, the second spiral element 156 is interspiraled relative to the first spiral element 150. The second spiral element 156 additionally includes a triangular region 155 adjacent the terminal second end 160 and a triangular region 159 orthogonal to the first triangular region 155 of the second spiral element 156. Radiator 162 includes reactive elements or circuit elements connected with an adjacent unit cell 130. Radiator 162 on unit cell 130 includes a first pair of resistors 164. Particularly, a first resistor 164A is connected adjacent the terminal second end 154 of the first spiral element 150. A second resistor 164B is adjacent the terminal second end 160 of the second spiral element 156. Additionally, a second pair of resistors 166 is connected to the respective spiral elements orthogonally to the first pair of resistors 164. More particularly, a third resistor 166A is connected to the first spiral element 150 at a location orthogonal to the first resistor 164A. A fourth resistor 166B is connected with the second spiral element 156 at a location orthogonal to the second resistor 164B.

The first spiral element 150 may include a third triangular region 161 and a fourth triangular region 163. The third triangular region 161 is positioned along the spiral element between the first triangular region 155 and the second triangular region 159. In one particular embodiment, the third triangular region 161 is located midway along the arc length between the first triangular region 155 and the second triangular region 159. The third triangular region 161 may be at any circumferential point of the arc between the first triangular region 155 and the second triangular region 159; however, in one particular embodiment, the approximate mid-point is at an angle 45 degrees relative to each the first triangular region 155 and the second triangular region 159 inasmuch as the first and second triangular regions 155, 159 are orthogonal to each other. The first spiral element 150 further includes a fourth triangular region 163 that is located orthogonally to the third triangular region 161. The fourth triangular region 163 is offset on an opposite side of the second triangular region 159 and is at an angle similar relative to the second triangular region 159 equal to that of the third triangular region 161. Similarly, the second spiral element 156 includes a third triangular region 161 and a fourth triangular region 163. The third triangular region 161 is diametrically opposite the third triangular region 161 on the second spiral element 156. Additionally, the fourth triangular region 163 on the first spiral element 150 is diametrically opposite the fourth triangular region 163 on the second spiral element 156. Radiator 162 further includes a third pair of resistors 165. The third pair of resistors 165 further includes a fifth resistor 165A coupled to the first spiral element 150 and positions the fifth resistor 165A between the first resistor 164A and the third resistor 166A. In one particular embodiment, the fifth resistor 165A is located at a midway point approximately 45 degrees between the first resistor 164A and the third resistor 166A inasmuch as the first resistor 164A is orthogonal to the third resistor 166A. Similarly, a sixth resistor 165A is positioned along the second spiral element 156 between the second resistor 164B and the fourth resistor 166B. Inasmuch as the second resistor 164B is orthogonal to the fourth resistor 166B, the sixth resistor 165B is at approximately 45 degrees between the second resistor 164B and the fourth resistor 166B. A fourth pair of resistors 167 includes a seventh resistor 167A connected to the first spiral element 150 at a position that is orthogonal to the fifth resistor 165A and on an opposite side of the third resistor 166A. An eighth resistor 167B is coupled with the second spiral element 156 at a position orthogonal to the sixth resistor 165B and on an opposite side of the fourth resistor 166B. The third pair of resistors 165 and the fourth pair of resistors 166 enable the radiator 162 to be diagonally coupled with diagonally adjacent unit cells 30 via strip lines 169. The first end 152 of the spiral element 150 is electrically connected with the first differential transmission line 70 through the horizontal first substrate 38. The first end 158 of the second spiral 156 is electrically connected to the second differential transmission line 72 through the horizontal first substrate 38. The remaining portions of the unit cell 130 having the second embodiment radiator 162 identified in FIG. 12 establish a unit cell 130 that connects via its pairs of resistors both orthogonally and diagonally to adjacent unit cells 130 in the antenna array. Each spiral element 150, 156 radiator is cavity-backed.

Figure 14:
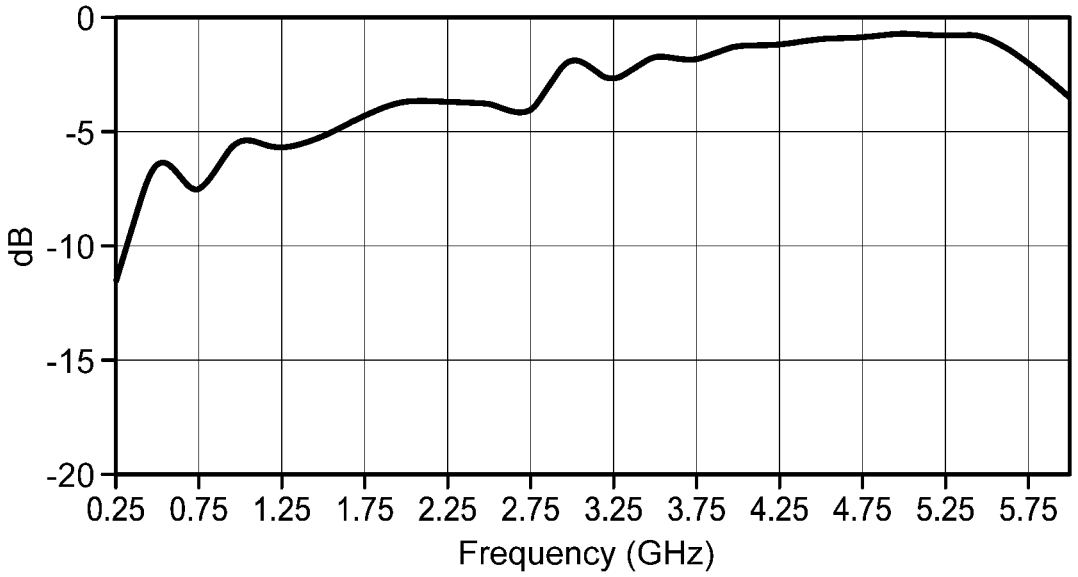
FIG. 14 is a unit cell efficiency graph of the antenna unit cell of FIG. 12 for frequencies ranging from 0.25 GHz to 5.75 GHz.

FIG. 14 is a simulated graph of the unit cell efficiency of the unit cell 130 that is orthogonally connected and diagonally connected via resistors to adjoining and adjacent and diagonal unit cells 130. The unit cell 130 has a unit cell efficiency as indicated by FIG. 14 that is between 0 and about −7 dB for frequencies between 0.75 and 5.75 GHz.

Figure 15:
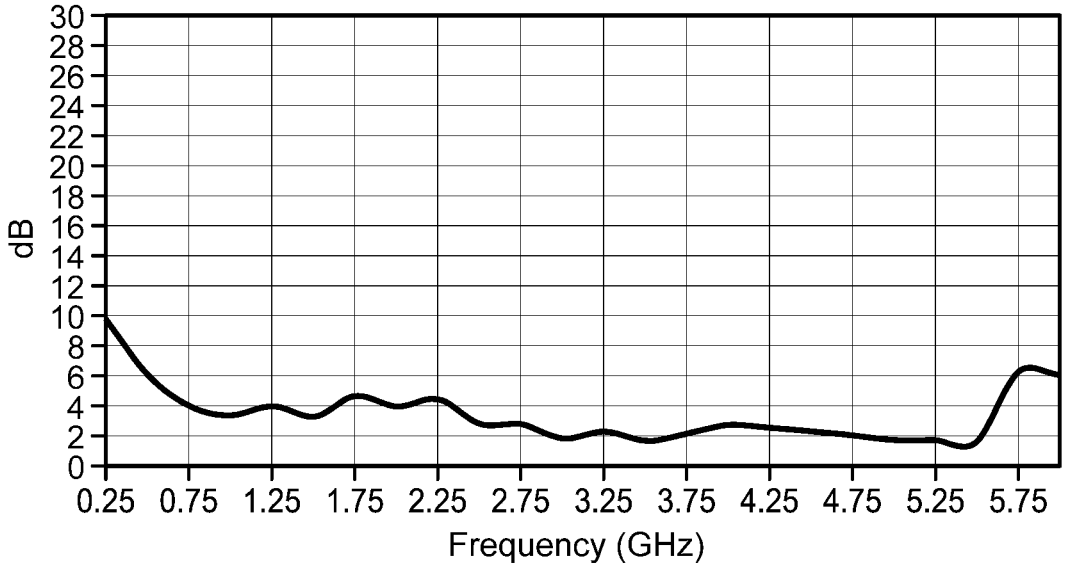
FIG. 15 is a unit cell axial ratio of the graph of the antenna unit cell of FIG. 12 for frequencies ranging from 0.25 GHz to 5.75 GHz.

FIG. 15 indicates the simulated unit cell axial ratio of the unit cell 130. Namely, the unit cell axial ratio of the unit cell 130 is less than about 4 dB for frequencies between 0.5 GHz and 5.5 GHz.

Figure 16:
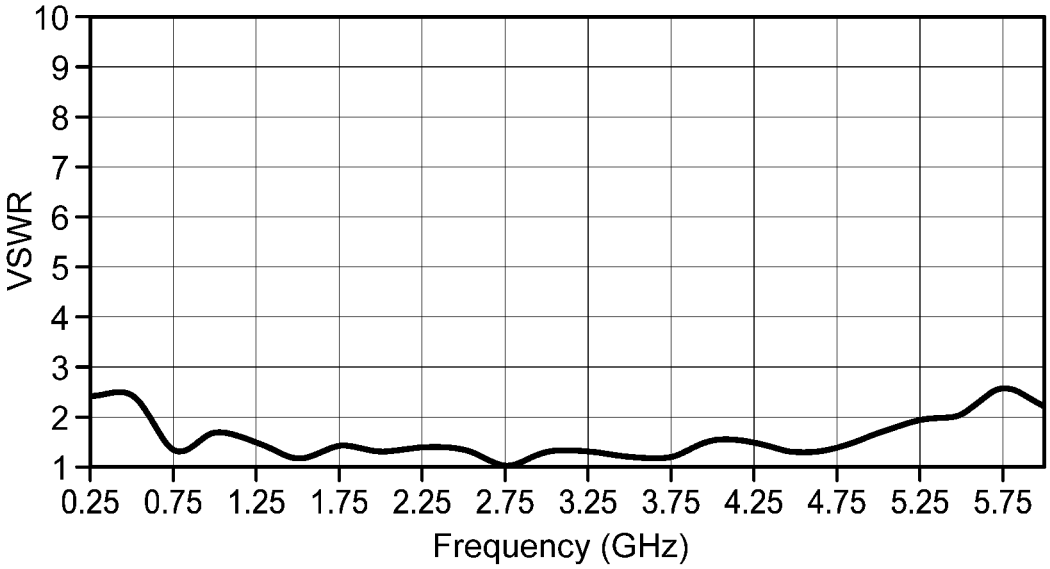
FIG. 16 is a unit cell 50-Ohm input match graph for the antenna cell unit of FIG. 12 for frequencies ranging from 0.25 GHz to 5.75 GHz.

FIG. 16 depicts the simulated unit cell 50 OHM input match for the unit cell 130. The voltage standing wave ratio (VSWR) is less than about 2 for frequencies between 0.75 GHz and 5.25 GHz for the unit cell 130.

Figure 17:
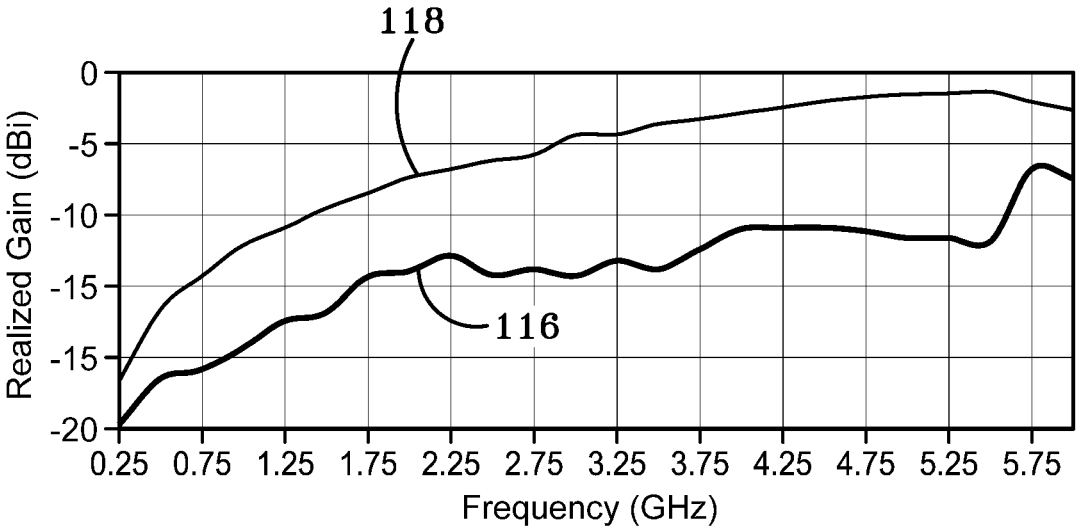
FIG. 17 is a unit cell right-handed and left handed circularly polarized gain at the boresight of the antenna cell unit of FIG. 12 for frequencies ranging from 0.25 GHz to 5.75 GHz.

FIG. 17 represents the simulated left-handed circular polarization by line 116 and the right-handed circular polarization by line 118 of the unit cell 130. The polarized gain at the bore site of the left-handed and right-handed polarization lines 116, 118 indicates that the right-handed polarization line 118 is a relatively smooth fit curve between 0.75 GHz and 5.25 GHz. At about 0.75 GHz, the right-handed circular polarization has a realized gain of about −15 dBi and the realized gain at 525 GHz is about −1 dBi.

Figure 18:
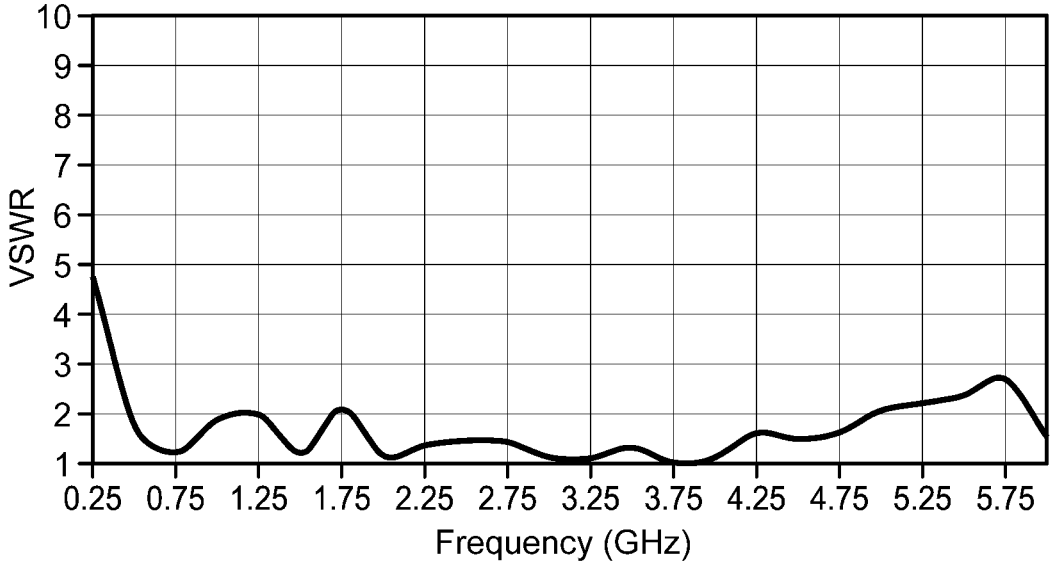
FIG. 18 is a unit cell 50-Ohm input match graph for the antenna cell unit of FIG. 12 coupled with an 8-way power divider for frequencies ranging from 0.25 GHz to 5.75 GHz.

FIG. 18 represents the simulated cascaded 50 OHM input match of the voltage standing wave ratio of the unit cell 130 connected with a power divider 32 embodied as an 8-way Wilkinson splitter. When the 8-way Wilkinson splitter is the power divider 32 connected with the unit cell 130, the voltage standing wave ratio is less than about 2 for frequencies between 0.75 GHz and 5.25 GHz.

Figure 19:
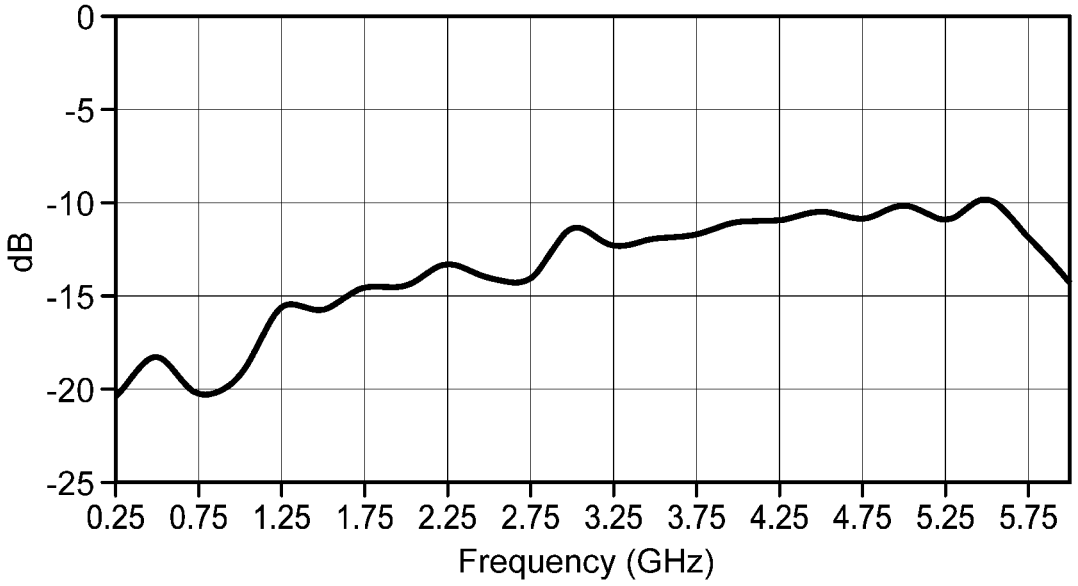
FIG. 19 is a unit cell efficiency graph of the antenna unit cell of FIG. 12 coupled with an 8-way power divider for frequencies ranging from 0.25 GHz to 5.75 GHz.

FIG. 19 represents the simulated bandwidth for a cascaded single unit cell 130 connected with the power divider 32 embodied as an 8-way Wilkinson splitter. The bandwidth is between −20 dB and about −10 dB for frequencies from 0.75 GHz to 5.75 GHz.

Figure 20:
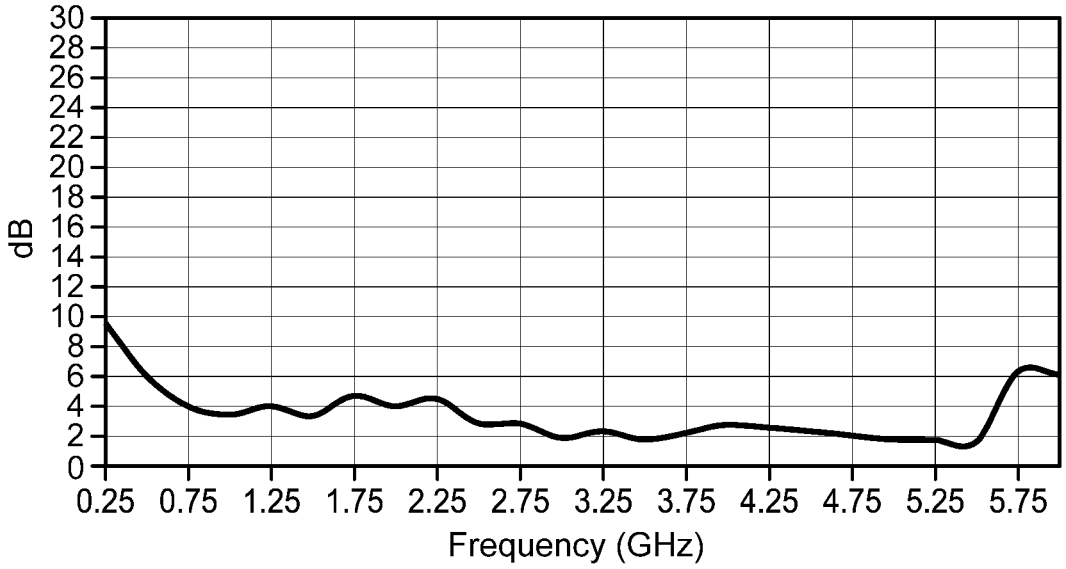
FIG. 20 is a unit cell axial ratio of the graph of the antenna unit cell of FIG. 12 coupled with an 8-way power divider for frequencies ranging from 0.25 GHz to 5.75 GHz.

FIG. 20 represents the simulated cascaded axial ratio of the unit cell 130 powered by the power divider 32 embodied as an 8-way Wilkinson splitter. The cascaded axial ratio is less than about 4 dB for frequencies between 0.75 GHz and about 5.25 GHz.

In accordance with one aspect of the present disclosure, antenna 10 having either unit cells 30 or unit cells 130 is circularly polarized. Because the antenna 10 is circularly polarized, the unit cells are sensitive to all polarizations. Thus, antenna 10 is sensitive to circular polarizations and linear polarizations in any orientation. The unit cells 30 or 130 may all be either RHC polarized or LHC polarized.

The tightly coupled spiral array antenna 10 is distinct from phase array antennas that utilize dipole phased arrays. The spiral radiator 62 or 162 is circularly polarized which gives an advantage over the previous dipole phased arrays that are inherently linearly polarized. As such, the antenna 10 is sensitive to all polarizations, whereas a linear dipole array is only sensitive to one polarization (i.e., linear polarization).

The antenna 10 having either unit cells 30 or unit cells 130 provides effective impedance matching between adjacent spiral radiators and the coupling between the spirals. This is typically a concern since a radiating spiral radiator affects the signal from an adjacent or neighboring spiral radiator 62 or 162. This results in scan anomalies which are when signals change phasing between multiple elements that result in gaps in efficiencies and spikes and dips in the voltage standing wave ratio (VSWR). The present disclosure addresses these issues by the tight coupling (i.e., the spacing distance 31 between adjacent unit cells 30 or 130 coupled via the circuit element is at most half of a wavelength ($\lambda/2$) at a frequency maximum) of the array antenna between adjacent spiral radiators and controlling the same and tuning the same such that these anomalies are significantly reduced. This enables the spiral radiators 62 or 162 to be tightly packed. Again, the term "tightly coupled" refers adjacent radiating elements are coupled to each other through a reactive element or circuit element, such as a resistor or a capacitor or an inductor, that is at most half of a wavelength ($\lambda/2$) at a frequency maximum.

In accordance with one aspect of the present disclosure, the tightly coupled spiral radiators of the antenna elements established by the reactive couplings or circuit elements (the resistors or capacitors or inductors) between adjacent radiators enables inductance of the spiral radiator to be tuned out and enables the phase to be tuned. Stated otherwise, in order to have right-handed circular polarization or left-handed circular polarization, the amplitude should be equal in 90 degree increments or an orthogonal fashion and the amplitudes should be equal (i.e., the phase must be equal) at a 90 degree offset. The reactive components or circuit elements help maintain the 90 degrees or orthogonal phase offset so that reflections from the end of the spiral do not interfere with the signal produced by the antenna.

When the adjacent antenna unit cells are connected via capacitors, the load is a reactive load. When the adjacent antenna unit cells are connected via resistors, the load is a lossy load. The ends of the spiral elements are controlled due to the location of the resistors that attenuate any current that is reflecting back into the feed to improve the axial ratio, which is a measure of circular polarization, and the cost of efficiency. In one particular example, some differences that factor in determining whether the array antenna of the present disclosure should use resistive elements coupling adjacent radiators or capacitive elements coupling adjacent radiators depends on whether the antenna system needs a great efficiency or a greater axial ratio. If a greater axial ratio is needed (i.e., good circular polarization over the entire frequency band), then a resistively coupled spiral array is utilized. If efficiency is a greater factor in the antenna design, then the spiral array that has capacitively elements is utilized. The gain is also higher in the capacitively coupled version of the array antenna than compared to the gain of a resistively coupled spiral array antenna.

The term "frequency independent" with respect to the radiating structures or radiators 62 or 162 refers to the actual spiral of the radiator may be scaled geometrically to match any bandwidth. Since bandwidth is usually measured in a ratio, such as in this case that is 12:1, the bandwidth may be shifted to greater frequencies or lower frequencies and still use the concepts of the tightly coupled spiral array of the present disclosure.

The present disclosure may utilize a differential feed. This refers to that one feed is 180 degrees from the other feed. The balun 68 provides a balanced to unbalanced structure that enables the conversion from single-ended to differential feeds. The double-y balun 68 is an instantiation of this feature. This is distinct from a conventional array that utilizes a single ended connector connects with a cable, such as an SMA cable.

In accordance with another aspect of the present disclosure, the differential transmission lines 70, 72 that extend vertically upward through the horizontal substrate and connect with the beginning end of the spiral radiators provides that for a given frequency band, the structure is linearly polarized for the lower half of the frequency band and is circularly polarized for the upper half of the frequency band. The structure of unit cell 30 or 130 enables the frequency band to be scaled to any desired or optimized required band. Thus, the physical size of the structure of antenna 10 may be increased to increase the frequency band. For the resistively coupled variety of the antenna element having unit cell 130, the circular polarization is available over the entire frequency band. The cutoff frequency for the circular polarization is due to the fact that the spiral is not large enough. Thus, if the spiral was larger, such as the unit cell 130 itself was larger, then the circular polarization would be at a lower frequency. However, this may be limited since it is constrained by grating lobes. Thus, antenna 10 is grating lobe free so that no constraints are applied by tightly coupling the unit cells 30 or 130 at a distance of less than or equal to (i.e., at most) wavelength divided by two (λ\2).

Grating lobes are undesirable in antenna configuration as they are extra main beams produced by the antenna array. The spacing distance 31 of adjacent unit cells at a distance of less than wavelength divided by two (λ/2) solves the problem associated with grating lobes. The wavelength divided by two is determined by the highest frequency of the bandwidth of the array.

When implementing the array antenna 10 of the present disclosure, the system identifies a highest frequency (i.e., a frequency maximum) and a lowest frequency (i.e., a frequency minimum) in which the antenna array needs to operate. This establishes a high frequency and a low frequency operative parameter. Then, a system can identify what the spacing distance 31 between adjacent unit cells should be in order to eliminate or reduce grating lobes. Thus, once the operative frequency parameters are selected, the array antenna 10 may be constructed in a manner to tightly couple adjacent antenna elements at a spacing of less than or equal to wavelength divided by two at the high frequency.

In accordance with one aspect of the present disclosure, the antenna array utilizes a Wilkinson power splitter or power divider such that connectors are not needed for every unit cell due to the size of the array. Wilkinson power divider combines the unit cell elements into a single connector. In one particular example, an eight wave Wilkinson splitter is utilized to connect eight antenna unit cells to a single power feed. The antenna of the present disclosure further incorporates time delays into the Wilkinson splitter. The time delays allow the antenna to steer the beam. Essentially, the time delay changes the phase between unit cell elements in the antenna array and the beam can be steered along a direction. In one particular embodiment, the time delay of the present disclosure steers the beam 30° in a desired direction. In order to time delay the Wilkinson power divider, the angle of incidence or the angle at which the beam needs to be steered must be calculated. After the angle of incidence has been calculated or determined, a system needs to determine what the time delay of a beam for that angle of incidence would be from element to element. Once the time delay is determined from element to element, then the system converts that to a path length difference in a micro strip line. FIGS. 9-11 represent the simulated performance of the unit cell cascaded with an eight-way Wilkinson power splitter.

In accordance with one aspect of the present disclosure, the embodiment of the circularly polarized array antenna having resistively coupled unit cells is able to be optimized depending on the current moving through the unit cell for a given frequency. In one particular embodiment, as noted above, the resistance of the resistors that couple the diagonals of each unit cell to adjacent diagonal unit cells is different than the resistance of the resistors coupling adjacent unit cells. With reference to the first embodiment, it may be possible in some implementations to provide a capacitively coupled unit cell diagonally connected with a capacitor similar to that which is taught in the embodiment using resistive couplers. However, utilizing a capacitor on a diagonal connection to another unit cell may reduce efficiency because the circuit will try to turn the diagonal capacitor into a short.

The radome is a semi-rigid structure utilized to protect the unit cells and radiating apertures or radiators from the outside environment. In accordance with one aspect of the present disclosure, the protective cover, which may be radome, needs to have a permittivity of around four to preserve the axial ratio and efficiency of the array antenna of the present disclosure. A higher permittivity may be detrimental because the use of a higher dielectric constant above the radiator may distort the radiation pattern or change the radiation characteristics, including the input match.

In another aspect, an exemplary embodiment of the present disclosure provides cavity-backed frequency-independent spiral radiators 62 in a right-handed or left-handed circularly polarized orientation that are capacitively coupled to adjacent elements in orthogonal directions at λ/2.46 at the highest frequency of operation above a parallel ground plane and manufactured on a single continuous λ/98.4 thick substrate 38 having permittivity 2.98. A radiating layer λ/7.87 thick filled with foam 106 of permittivity 1.05 above the radiators is followed by a λ/15.74 thick radome cover 14 of permittivity 4.00. In this configuration a 12:1 useable bandwidth and a 6:1 axial ratio bandwidth of less than 6 decibels is achieved with an average efficiency of 63%.

In another aspect, an exemplary embodiment of the present disclosure provides cavity-backed frequency-independent spiral radiators 162 in a right-handed or left-handed circularly polarized orientation resistively coupled to adjacent and diagonal elements at λ/2.46 at the highest frequency of operation above a parallel ground plane and manufactured on a single continuous λ/98.4 thick substrate 38 of permittivity 2.98. A radiating layer λ/7.87 thick filled with foam 106 of permittivity 1.05 above the radiators 162 is followed by a λ/15.74 thick radome cover 14 of permittivity 4.00. In this configuration a 24:1 useable bandwidth and a 12:1 axial ratio bandwidth of less than 6 decibels is achieved with an efficiency ranging from 20%-85%.

In some instances, each radiator 62, 162 may be fed using an orthogonally oriented double-y balun with common-mode rejection loops manufactured on parallel rows of substrates (which, in one example may be λ/49.2) thick of permittivity about 2.98 to transition from at least one grounded microstrip to at least one slotline. The radiator substrate and feed substrates may be joined by extending the slotline feed through the radiator substrate at the radiator feed points and electrically connecting the slotline to the radiator.

An exemplary embodiment of the present disclosure may provide a tightly-coupled ultra-wide bandwidth array antenna with right-hand circular polarization in the upper half of the band that transitions to vertical polarization in the lower half. This configuration provides good efficiency characteristics throughout. The array antenna includes capacitively-coupled frequency-independent spiral radiators fed by a precision tuned double-y balun with integrated common-mode rejection loops manufactured on horizontally and vertically oriented printed circuit boards (PCBs), respectively. The capacitive coupling approach may double the operational bandwidth of the design from 6:1 to 12:1 (VSWR<2:1 referenced to 50-Ohm input on average) while maintaining efficient performance (−2 dB on average) and improving the axial ratio across the upper-half of the band (AR<6 dB) while smoothing out the transition to vertical polarization in the lower-half.

In another exemplary embodiment, single-ended RF connectors attached to the microstrip portion of the feed substrates may be used to individually interface with each element. In another exemplary embodiment, an N-way Wilkinson power divider may be used to feed each row of N double-y baluns feeding N radiators and should be manufactured on the same substrate as the double-y baluns. A single-ended RF connector may be attached to the feed point on the Wilkinson power divider. In another exemplary embodiment, an N-way Wilkinson power divider with progressively lengthened transmission lines producing a progressive time delay across each port may be used to feed each row of N double-y baluns feeding N radiators in order to steer the main beam of the array to a fixed angle along a plane parallel to the row.

Figure 21:
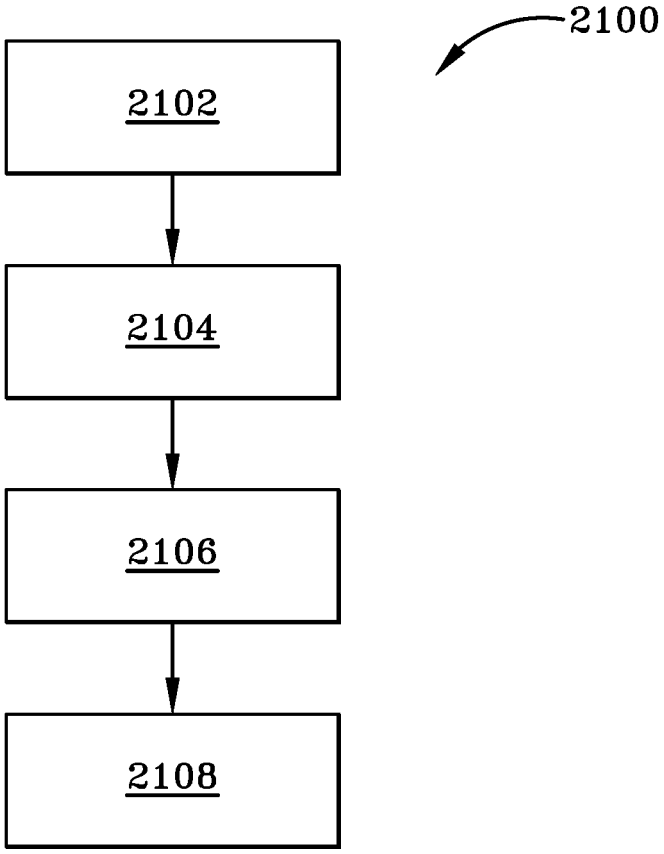
FIG. 21 is a flow chart depict an exemplary method in accordance with one aspect of the present disclosure.

FIG. 21 depicts a method a method of operating an array antenna in accordance with one aspect of the present disclosure generally at 2100. Method 2100 includes radiating energy from a circularly polarized radiator 62 or 162 including two inter-spiraled elements fed from the balun 68, wherein the radiator is coupled with an adjacent radiator via a circuit element at a spacing distance 31 between adjacent radiators that is at most half of a wavelength at a frequency maximum of the array antenna, which is shown generally at 2102. Method 2100 may include reducing the likelihood, or even eliminating, grating lobes from the array antenna based, at least in part, on the spacing distance 31, which is shown generally at 2104. Method 2100 may include maintaining an excitation value of the array antenna at a relative phase of 90 degrees between terminal ends of two inter-spiraled elements, which is shown generally at 2106. The excitation value refers to the application of voltage to the antenna for producing field in the device such that there is a relative phase difference of 90 degrees between terminal ends 54,60 of two inter-spiraled elements 50,56, respectively. Method 2100 may further include receiving a linearly polarize signal at the circularly polarized radiator, which is shown generally at 2108.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

In addition to the aspects disclosed herein, this antenna can be used to interface with any multi-channel receiver system or potentially shared as an aperture resource among receiver systems or potentially used to interface with a multi-function RF converged system.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. An array antenna comprising:

a plurality of antenna unit cells;

a circularly polarized radiator on at least one unit cell from the plurality of antenna unit cells, the circularly polarized radiator comprising, a first spiral element spiraling from a first end to a terminal second end; and a second spiral element spiraling from a first end to a terminal second end;

a balun on the at least one unit cell from the plurality of antenna unit cells;

a circuit element on the circularly polarized radiator that is coupled to an adjacent unit cell, wherein the circuit element is one of a capacitor, a resistor, and an inductor;

a spacing distance between adjacent unit cells coupled via the circuit element that is at most half of a wavelength at a frequency maximum of the array antenna, wherein the spacing distance reduces likelihood of grating lobes;

wherein an excitation value of the array antenna maintains a relative phase of 90 degrees between the terminal ends of the first spiral element and the second spiral element.

2. The array antenna of claim 1, further comprising:

a first substrate carrying the circularly polarized radiator, wherein the first spiral element and the second spiral element are arranged in an inter-spiraled configuration on the first substrate, and wherein the first spiral element tapers from the first end to the second end thereof;

a cavity back defined by the first spiral element and the second spiral element.

3. The array antenna of claim 1, further comprising:

a first pair of capacitors, wherein the circuit element is a first capacitor connected to the terminal second end of the first spiral element and a second capacitor is connected to the terminal second end of the second spiral element.

4. The array antenna of claim 3, further comprising:

a second pair of capacitors including a third capacitor connected to the first spiral element orthogonally to the first capacitor and a fourth capacitor connected to the second spiral element orthogonally to the second capacitor.

5. The array antenna of claim 4, wherein the first capacitor, the second capacitor, the third capacitor, and the fourth capacitor are all equal in capacitance.

6. The array antenna of claim 1, further comprising:

a first pair of resistors, wherein the circuit element is a first resistor connected to the terminal second end of the first spiral element and a second resistor is connected to the terminal second end of the second spiral element.

7. The array antenna of claim 6, further comprising:

a second pair of resistors including a third resistor connected to the first spiral element orthogonally to the first resistor and a fourth resistor connected to the second spiral element orthogonally to the second resistor.

8. The array antenna of claim 7, wherein the first resistor, the second resistor, the third resistor, and the fourth resistor are all equal in resistance.

9. The array antenna of claim 8, further comprising:

a third pair of resistors including a fifth resistor connected to the first spiral element between the first resistor and the third resistor, and a sixth resistor connected to the second spiral element between the second resistor and the fourth resistor.

10. The array antenna of claim 9, wherein the fifth resistor is configured at an angle of about 45 degrees between the first resistor and the third resistor.

11. The array antenna of claim 9, further comprising:

a fourth pair of resistors including a seventh resistor connected to the first spiral element orthogonal to the fifth resistor opposite the third resistor, and an eighth resistor connected to the second spiral element orthogonal the sixth resistor opposite the fourth resistor.

12. The array antenna of claim 11, wherein the fifth resistor, the sixth resistor, the seventh resistor, and the eighth resistor are all equal in resistance, and all different in resistance than the first resistor, the second resistor, the third resistor, and the fourth resistor.

13. The array antenna of claim 1, further comprising:

a first differential transmission line of the balun connected with the first end of the first spiral element through a first substrate; and a second differential transmission line of the balun connected with the first end of the second spiral element through the first substrate.

14. The array antenna of claim 1, further comprising:

wherein the balun is a double-y balun oriented orthogonally to the circularly polarized radiator; and an operational bandwidth that is at least 12:1 while maintaining an average performance efficiency of about −2 dB.

15. The array antenna of claim 1, further comprising:

common mode rejection loops in electrical communication with the balun and a common ground strip.

16. The array antenna of claim 1, further comprising:

a connection of the unit cell to a diagonally adjacent unit cell having a spacing distance that is at most half of a wavelength at a frequency maximum of the array antenna.

17. The array antenna of claim 1, further comprising:

an N-way power divider to feed a row of N unit cells, wherein N is any integer greater than two.

18. The array antenna of claim 17, further comprising:

progressively lengthened transmission lines on the N-way power divider producing a progressive time delay across each port to feed a row of N unit cells in order to steer a main beam of the phased array antenna to a fixed angle along a plane parallel to the row.

19. A method of operating an array antenna comprising:

radiating energy from a circularly polarized radiator including two inter-spiraled elements fed from a balun, wherein the radiator is coupled with an adjacent radiator via a circuit element at a spacing distance between adjacent radiators that is at most half of a wavelength at a frequency maximum of the array antenna;

spacing the circularly polarized radiator at the spacing distance to reduce the likelihood of grating lobes from the array antenna;

maintaining an excitation value of the array antenna at a relative phase of 90 degrees between terminal ends of two inter-spiraled elements; and receiving a linearly polarize signal at the circularly polarized radiator.

* * * * *